US009117421B2

(12) United States Patent
McMorrow

(10) Patent No.: US 9,117,421 B2
(45) Date of Patent: Aug. 25, 2015

(54) FULLY TEMPERED DUPLEX SCALE

(71) Applicant: Edward J. McMorrow, Edmonds, WA (US)

(72) Inventor: Edward J. McMorrow, Edmonds, WA (US)

( * ) Notice: Subject to any disclaimer, the term of this patent is extended or adjusted under 35 U.S.C. 154(b) by 111 days.

(21) Appl. No.: 13/666,078

(22) Filed: Nov. 1, 2012

(65) Prior Publication Data

US 2013/0205968 A1 Aug. 15, 2013

Related U.S. Application Data

(60) Provisional application No. 61/597,158, filed on Feb. 9, 2012.

(51) Int. Cl.
*G10C 3/08* (2006.01)
*G10C 3/04* (2006.01)

(52) U.S. Cl.
CPC ..... *G10C 3/08* (2013.01)

(58) Field of Classification Search
USPC ..... 84/197
See application file for complete search history.

(56) References Cited

U.S. PATENT DOCUMENTS

| | | | | | |
|---|---|---|---|---|---|
| 126,848 | A | | 5/1872 | Steinway | |
| 888,065 | A | | 5/1908 | Chickering | |
| 1,026,922 | A | | 5/1912 | Nystrom | |
| 1,551,771 | A | * | 9/1925 | Pease | 84/234 |
| 1,769,284 | A | * | 7/1930 | Betz | 84/197 |
| 1,838,833 | A | | 12/1931 | Holmberg | |
| 1,972,511 | A | * | 9/1934 | Bilhuber | 84/188 |
| 2,217,021 | A | * | 10/1940 | Klepae | 84/188 |
| 2,296,698 | A | | 9/1942 | Benioff | |
| 3,477,331 | A | | 11/1969 | Conklin, Jr. | |
| 3,523,480 | A | | 8/1970 | Conklin, Jr. | |
| 3,956,962 | A | | 5/1976 | Fields | |
| 4,383,465 | A | * | 5/1983 | Conklin, Jr. | 84/199 |

(Continued)

FOREIGN PATENT DOCUMENTS

| | | |
|---|---|---|
| DE | 102005002019 | 7/2006 |
| GB | 1047005 | 11/1966 |
| GB | 2329276 | 3/1999 |

OTHER PUBLICATIONS

Fundamentals of Piano Practice: Expert Piano Restoration: 2.5.6 Equalizing String Tension. Piano Restoration Factory. 2009. http://www.pianofundamentals.com/book/en/2.5.6.*

(Continued)

*Primary Examiner* — Christopher Uhlir
(74) *Attorney, Agent, or Firm* — Klarquist Sparkman, LLP

(57) ABSTRACT

Disclosed herein are exemplary embodiments of methods, systems, and apparatus for improving pianos and like musical instruments. For example, in certain embodiments, the improvements are in the structures of the piano (or like musical instruments) that affect the vibratory relationships between the struck string and other segments of said string. The improvements affect how these vibratory relationships of the string segments interact with the bridge, soundboard, the plate of a piano, the string rests, and/or the string terminations. For example, in embodiments of the disclosed technology, the vibratory relationships of the string segments involve transient transverse (T) and longitudinal (L) frequencies as well as sustained transverse, longitudinal, and horizontal (H) modes carried by said string segments and their support structures. Embodiments of the disclosed technology also affect how these relationships are defined across the compass of the standard piano keyboard.

44 Claims, 8 Drawing Sheets

(56) References Cited

U.S. PATENT DOCUMENTS

| | | | | |
|---|---|---|---|---|
| 4,674,386 | A * | 6/1987 | Conklin, Jr. | 84/216 |
| 5,736,660 | A | 4/1998 | Frankel | |
| 5,874,685 | A | 2/1999 | Ellis | |
| 6,100,457 | A * | 8/2000 | Harris et al. | 84/211 |

OTHER PUBLICATIONS

International Search Report dated May 30, 2013, from International Patent Application No. PCT/US2013/025357, 4 pp.

Written Opinion dated May 30, 2013, from International Patent Application No. PCT/US2013/025357, 5 pp.

* cited by examiner

FULLY TEMPERED DUPLEX SCALE

CROSS REFERENCE TO RELATED APPLICATION

This application claims the benefit of U.S. Provisional Application No. 61/597,158 entitled "FULLY TEMPERED DUPLEX SCALE" filed on Feb. 9, 2012, which is hereby incorporated herein in its entirety.

FIELD

This application relates to methods, apparatus, and systems to improve the musical sound and utility of notes in the upper range of a stringed instrument, such as a piano.

BACKGROUND

Nearly all musicians find the treble portion of the piano compass weak compared to the volume, dynamic range, sustain, and tonal color of the lower portion. This weakness makes any note-to-note unevenness in the treble more apparent in many musical contexts. Piano tone-regulation procedures used to produce an even dynamic range across the entire compass involve voicing the more powerful sections of notes down to match the weakest section. The top two octaves of even the best pianos invariably have an excess of "woody", hammer impact sound that is most prominent during loud playing. Accordingly, improved methods, apparatus, and systems for manufacturing, repairing, adjusting, and/or modifying a piano or like musical instrument to improve the musical utility of treble notes are desired.

SUMMARY

Disclosed below are representative embodiments of methods, systems, and apparatus for improving pianos and like musical instruments. For example, in certain embodiments, the improvements are in the structures of the piano (or like musical instruments) that affect the vibratory relationships between the struck string and other segments of said string. The improvements affect how these vibratory relationships of the string segments interact with the bridge, soundboard, the plate of a piano, the string rests, and/or the string terminations. For example, in embodiments of the disclosed technology, the vibratory relationships of the string segments involve transient transverse (T) and longitudinal (L) frequencies as well as sustained transverse, longitudinal, and horizontal (H) modes carried by said string segments and their support structures. Embodiments of the disclosed technology also affect how these relationships are defined across the compass of the standard piano keyboard.

Embodiments of the disclosed technology can be used to better control: the production of L-mode and T-mode components of string motion; the production of heterodynes between L-mode to T-mode string motion; the production of heterodynes between T-mode to L-mode string motion; the production of heterodynes between L-mode to L-mode string motion; the production of heterodynes between T-mode to T-mode string motion; the production of bridge motion vectors caused by vibrating strings; the production, motion and response of the capo bar to the struck and duplex string vibratory modes; and/or the reduced coupling of the hammer impact noise to the air.

One of the exemplary embodiments disclosed herein is a stringed instrument comprising a plurality of string sets. Each string set comprises one or more strings tuned to a respective frequency. The string sets together form a graduated musical scale that ascends from a lower frequency to a higher frequency. The strings of each respective string set are divided between at least a duplex length portion and a speaking length portion, and the ratio between a length of string in the speaking length portion and a length of string in the duplex length portion defines a duplex ratio. The string sets are further arranged into at least a first grouping of two or more of the string sets and a second grouping of two or more of the string sets. In this embodiment, the duplex ratios of the string sets in the first grouping are consecutively graduated from one another and are all within a first duplex ratio range having no harmonic duplex ratios. The duplex ratios of the strings in the second grouping are consecutively graduated from one another and are all within a second duplex ratio range having no harmonic duplex ratios. Further, in this embodiment, the second duplex ratio range is separated from the first duplex ratio range by at least one harmonic duplex ratio, and the strings in the first grouping are tuned to higher frequencies than the strings in the second grouping. In certain implementations, the duplex ratios for two or more string sets of the stringed instrument are defined by a grouping shown in Table 3, which is set forth below. In some implementations, each string set has a duplex ratio different than the duplex ratio of any other string set. In certain implementations, the number of string sets in the first grouping is greater than the number of string sets in the second grouping. In some implementations, the stringed instrument further comprises duplex string rests positioned at a termination of the duplex length portion of the strings, the duplex string rests comprising an acetel copolymer, an acetel homopolymer, a carbon fiber composite, an aramid fiber composite, a phenolic material, a nylon material, or polytetrafluorethylene. Any of these string rest materials can be reinforced with fibers, microtubules, micro-spheres, or nano-scale materials, and/or any other suitable synthetic manufactured material (reinforced or not by any method) that is suitable for the above purpose. At least one of the duplex string rests can have a graduated, stepped shape. At least one of the duplex string rests can have grooves or holes for spacing the strings laterally. In certain implementations, the stringed instrument further comprises a capo bar having a capo bar string contact element that contacts the strings at the division of the duplex portion and the speaking length portion of the strings. Further, in some implementations, the capo bar comprises a hollow portion in which a damping material is positioned. The damping material can comprise one of lead, brass, Babbitt alloy, an acetel copolymer, an acetel homopolymer, an elastomeric silicone compound, an elastomeric polyurethane compound, polyurethane, an aramid fiber composite, a phenolic material, a nylon material, or polytetrafluorethylene. In certain implementations, the strings of each respective string set further include a hitching length portion, where the hitching length portion for a respective string set is equal or substantially equal in length to the speaking length portion for the respective string set. In some implementations, the stringed instrument further comprises hitching rests positioned at terminations of the hitching length portions of the strings. The hitching string rests can comprise one or more of an acetel copolymer, an acetel homopolymer, a carbon fiber composite, an aramid fiber composite, a phenolic material, a nylon material, or polytetrafluorethylene. Any of these string rest materials can be reinforced with fibers, microtubules, micro-spheres, or nano-scale materials, and/or any other suitable synthetic manufactured material (reinforced or not by any method) that is suitable for the above purpose. At least one of the hitching length string rests can have grooves or holes for spacing the strings laterally. In some implementations, the stringed instrument is a piano. Further, in certain implementations, the plurality of string sets is in the upper half of the piano's compass.

One of the exemplary embodiments disclosed herein is a stringed instrument comprising a plurality of string sets. Each string set comprises one or more strings tuned to a respective frequency. The string sets together form a graduated musical scale that ascends from a lower frequency to a higher frequency. The strings of each respective string set are divided between at least a duplex length portion and a speaking length portion, and the ratio between a length of string in the speaking length portion and a length of string in the duplex length portion defines a duplex ratio. The string sets are further arranged into at least a first grouping of two or more of the string sets and a second grouping of two or more of the string sets. Further, the strings in the first grouping have a first duplex ratio and the strings in the second grouping have a second duplex ratio. In this embodiment, the strings in the first grouping are tuned to higher frequencies than the strings in the second grouping, and the number of string sets in the first grouping is greater than the number of string sets in the second grouping. In certain implementations, the stringed instrument further comprises a third grouping of two or more of the string sets having a third duplex ratio. The strings in the first grouping and the second grouping are tuned to higher frequencies than the strings in the third grouping, and the number of string sets in the first grouping and the second grouping is greater than the number of string sets in the third grouping. In some implementations, the number of string sets in each grouping increases as the frequency of the strings in each grouping increases. In certain implementations, the duplex ratios for two or more string sets of the stringed instrument are defined by Table 1 or Table 2, which are disclosed below. In some implementations, each string set has a duplex ratio different than the duplex ratio of any other string set. In certain implementations, the stringed instrument further comprises a capo bar having a capo bar string contact element that contacts the strings at the division of the duplex portion and the speaking length portion of the strings. The capo bar and capo bar string contact element can be configured to reduce L-mode reflections without damping T-mode reflections. Further, in some implementations, the capo bar comprises a hollow portion in which a damping material is positioned. The damping material can comprise one of lead, brass, Babbitt alloy, an acetel copolymer, an acetel homopolymer, an elastomeric silicone compound, an elastomeric polyurethane compound, polyurethane, an aramid fiber composite, a phenolic material, a nylon material, or polytetrafluorethylene. In certain implementations, the strings of each respective string set further include a hitching length portion, where the hitching length portion for a respective string set is equal or substantially equal in length to the speaking length portion for the respective string set. In some implementations, the stringed instrument further comprises hitching rests positioned at terminations of the hitching length portions of the strings. The hitching string rests can comprise one or more of an acetel copolymer, an acetel homopolymer, a carbon fiber composite, an aramid fiber composite, a phenolic material, a nylon material, or polytetrafluorethylene. Any of these string rest materials can be reinforced with fibers, microtubules, micro-spheres, or nano-scale materials, and/or any other suitable synthetic manufactured material (reinforced or not by any method) that is suitable for the above purpose. In some implementations, the stringed instrument further comprises duplex string rests positioned at a termination of the duplex length portion of the strings. The duplex string rests can comprise one or more of an acetel copolymer, an acetel homopolymer, a carbon fiber composite, an aramid fiber composite, a phenolic material, a nylon material, or polytetrafluorethylene. Further, in certain implementations, at least one of the duplex string rests spans multiple string sets and is shaped so that the strings in a string set have a constant duplex ratio and so that the duplex ratios between the multiple string sets are different from one another. In some implementations, the stringed instrument is a piano. In some implementations, the duplex and hitching length string rests have grooves or holes to space the strings laterally. Further, in certain implementations, the plurality of string sets are in the upper half of the piano's compass.

Another of the exemplary embodiments disclosed herein is a stringed instrument comprising a plurality of string sets. Each string set comprises strings tuned to a respective frequency, and the string sets are arranged so that the respective frequencies for the string sets progress from a lower frequency to a higher frequency. The strings of each respective string sets are divided between at least a duplex length portion and a speaking length portion, and the ratio between a length of the strings in the speaking length portion and a length of the strings in the duplex length portion defines a duplex ratio. In this embodiment, a duplex string rest is positioned at a termination of the duplex length portion of at least one of the strings, and the duplex string rest comprises a non-metal synthetic material configured to reduce transmission of the longitudinal vibrational mode on at least one of the strings. For example, the synthetic material can be an acetel copolymer. The synthetic material can also be one of an acetel copolymer, an acetel homopolymer, a carbon fiber composite, an aramid fiber composite, a phenolic material, a nylon material, or polytetrafluorethylene. All of these string rest materials can be reinforced with fibers, microtubules, microspheres, or nano-scale materials and/or any other suitable synthetic manufactured material (reinforced or not by any method) that is suitable for the above purpose. In some implementations the stringed instrument further comprises a capo bar having a capo bar element that contacts the at least one of the strings at the division of the duplex portion and the speaking length portion of the at least one of the strings. In these implementations, the capo bar element can also comprise the non-metal synthetic material. For instance, in particular implementations, the capo bar element is an agraffe consisting essentially of the non-metal synthetic material. In some implementations, the duplex string rest has a graduated, stepped shape and is configured to serve as the duplex string rest for multiple ones of the string sets. The stepped shape of the duplex string rest is designed to create a common duplex ratio for each string in a respective string sets and to create different duplex ratios between each of the multiple ones of the string sets. In certain implementations, the duplex string rest has grooves or holes to space the strings laterally. In certain implementations, the stringed instrument is a piano. Further, in some implementations, the plurality of string sets is in the upper half of the piano's compass.

Another exemplary embodiment disclosed is a stringed instrument comprising a plurality of strings, and a capo bar coupled to a frame of the stringed instrument. The capo bar further comprises a capo bar string contact element that contacts the plurality of strings and thereby divides the strings into duplex length portions and speaking length portions. The capo bar is formed of a first material and defines a hollow region. This embodiment further comprises a damping element formed from a second material different than the first material and located in the hollow region of the capo bar. The second material is configured to dampen the transmission of vibrations from the capo bar string contact element to the air and to the frame of the stringed instrument. For example, in certain implementations, the damping element is formed of a non-metal synthetic material, lead, brass, or Babbitt alloy, an acetel copolymer, and acetel homopolymer, an elastomeric silicone compound, an elastomeric polyurethane compound, polyurethane, an aramid fiber composite, a phenolic material, a nylon material, or a polytetrafluorethylene compound. In some implementations, the capo bar is coupled to the frame via a non-metal synthetic element. In certain implementations, the capo bar string contact element is coupled to the capo bar by a non-metal synthetic element. In particular implementations, the stringed instrument is a piano.

Another of the exemplary embodiments disclosed herein is a stringed instrument comprising a plurality of string sets and a string rest positioned at a termination of a speaking length of at least one of the strings. Each string set comprises strings tuned to a respective frequency, and the string sets are arranged so that respective frequencies for the string sets progress from a lower frequency to a higher frequency. In this embodiment, the string rest comprises a non-metal synthetic material configured to reduce transmission of the longitudinal vibrational mode on the at least one of the strings. For example, the synthetic material can be an acetel copolymer. In further implementations, the synthetic material can be one of an acetel copolymer, an acetel homopolymer, a carbon fiber composite, an aramid fiber composite, a phenolic material, a nylon material, or polytetrafluorethylene. Any of these string rest materials can be reinforced with fibers, microtubules, micro-spheres, or nano-scale materials and/or any other suitable synthetic manufactured material (reinforced or not by any method) that is suitable for the above purpose.

The foregoing and other objects, features, and advantages of the invention will become more apparent from the following detailed description, which proceeds with reference to the accompanying figures.

DETAILED DESCRIPTION

I. General Considerations

Figure 1:
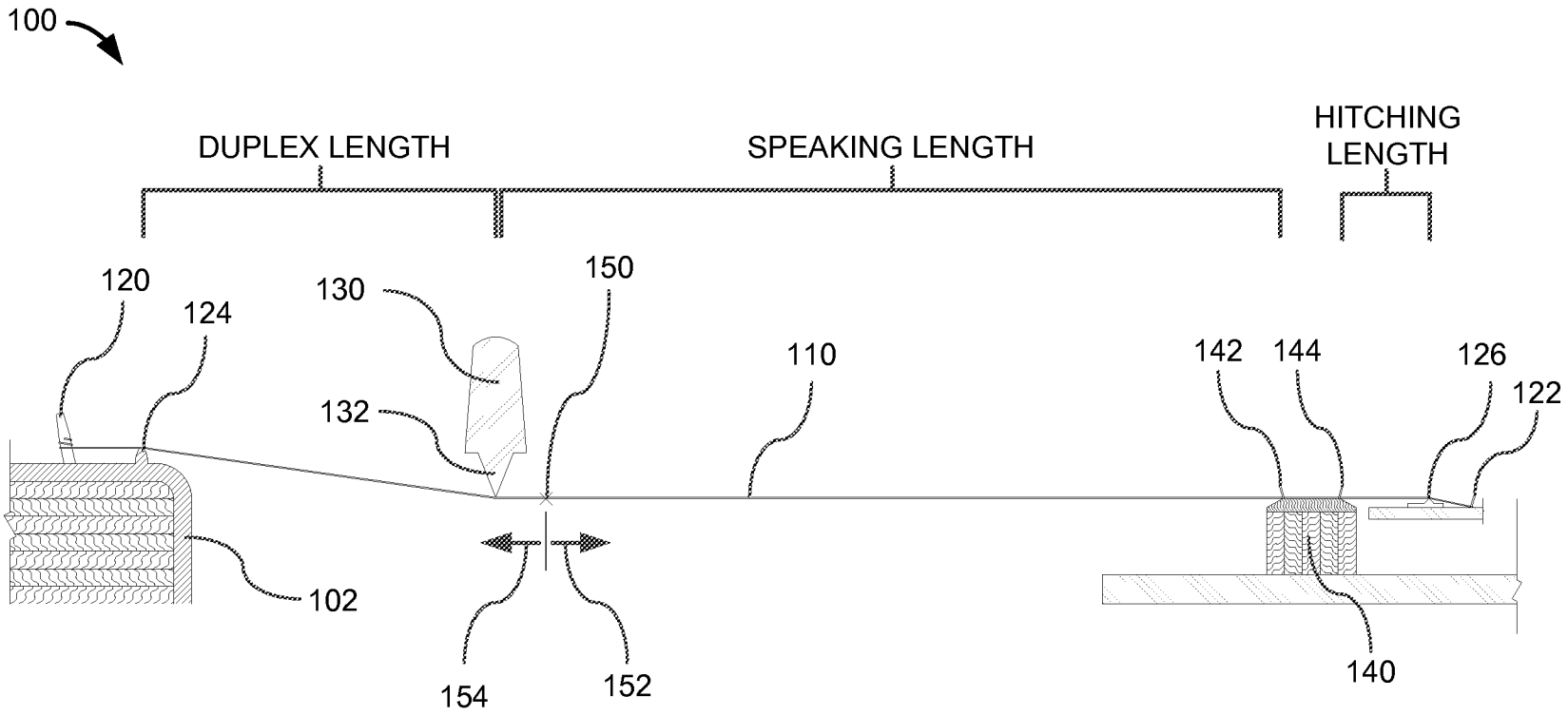
FIG. 1 is a schematic block diagram of an exemplary string arrangement illustrating concepts related to the disclosed technology.

Disclosed herein are representative embodiments of methods, systems, and apparatus for improving the musical sound and utility of notes in the upper range of a stringed instrument, such as a piano. The described methods, systems, and apparatus should not be construed as limiting in any way. Instead, the present disclosure is directed toward all novel and non-obvious features and aspects of the various disclosed embodiments, alone and in various combinations and sub-combinations with one another. The disclosed methods, systems, and apparatus are not limited to any specific aspect, feature, or combination thereof, nor do the disclosed methods, systems, and apparatus require that any one or more specific advantages be present or problems be solved. Moreover, for the sake of simplicity, the attached figures may not show the various ways in which the disclosed methods, systems, and apparatus can be used in conjunction with other systems, methods, and apparatus. Additionally, as used herein, the term "and/or" means any one item or combination of items in the phrase. As used herein and in the claims, the term "agraffe" generally refers to an element that carries one or more strings (e.g., the unison strings) of one struck note. Because the agraffe contacts the string, it creates a point where vibrations are generally reflected. Thus, the agraffe can be viewed as a termination element for the speaking length, duplex length, or hitch length of a string. An agraffe can be affixed to or installed on a plate, bridge, or the capo bar. The term "capo bar" generally refers to a structure that contacts a string near the hammer strike point and thereby helps define the speaking length of a string. The portion of the capo bar contacting a string is sometimes referred to herein as the "contact element" or "string contact element". The capo bar string contact element effectively serves as a speaking length termination point by dividing the string into an un-struck string segment and a struck string segment. The capo bar is usually cast integral with the plate but can be made separately and attached to the plate. The term "duplex" or "duplex length" generally refers to the un-struck string segment between a duplex string rest nearest the tuning pin and the capo bar. The term "duplex ratio" refers to the frequency ratio between the transverse modes of the duplex segment and the struck string segment. Further, on account of the inverse relationship between string length and frequency, the term "duplex ratio" can also refer to the ratio of the speaking length of a string to the duplex length of the string. The "duplex scale" term generally refers to the distribution of duplex ratios between the speaking length of the struck strings and their duplex segments across one or more notes (e.g., across the notes of the piano compass). The term "hitching length" refers to the un-struck string segment located between the bridge and the hitch-pin. The term "false beats" generally refers to heterodynes produced from a single vibrating string, usually due to disruptions at the termination points of the string that produce slightly different speaking lengths depending upon the angular momentums of the string and the bridge. The term "fundamental" generally refers to the lowest frequency mode of a periodically vibrating body. The term "transverse mode" or "T mode" refers to a vibrational mode corresponding to the periodic string motion that is parallel to the direction of the hammer strike. The term "horizontal transverse mode" or "HT mode" generally refers to a vibrational mode corresponding to the periodic string motion that is perpendicular to the direction of the hammer strike. The "longitudinal mode" or "L mode" refers to a vibrational mode corresponding to the end-to-end compression pulse in a string that is excited by localized increases of tension primarily at the hammer strike point, but that can also happen at the bridge. The term "pivot termination" generally refers to a defined point where a string is contacted (e.g., by the capo bar string contact element or agraffe) and about which the string pivots such that transverse string motion is allowed on both sides of the pivot termination due to the effects of string stiffness. Further, the term "tempering" generally refers to the process of setting specific ratio T-mode heterodynes between specific coincident partials of two notes that form a musical interval. In embodiments of the disclosed technology, the duplex is designed or adjusted to control L-mode heterodynes among and between string segment modes. Consequently, and as more fully explained below, certain embodiments disclosed herein are referred to as a "Fully Tempered Duplex Scale".

II. Introduction to Disclosed Technology

FIG. 1 is a schematic block diagram 100 illustrating components of a piano and a piano string assembly. In particular, FIG. 1 shows a string 110 that extends from a tuning pin 120 to a hitching pin 122. From the tuning pin 120, the string 110 extends over a duplex string rest 124, under capo bar 130 (and in particular, under the capo bar string contact element 132), and across bridge 140, where it contacts a first bridge pin 142 and a second bridge pin 144, and finally over hitching string rest 126. The capo bar string contact element 132 is shown as being integrally formed with the capo bar 130 in FIG. 1, but can also be a separate element, such as an agraffe. Also shown in FIG. 1 is a hammer strike point 150 where a hammer of a hammer mechanism (not shown) strikes the string 110 when the corresponding key of the piano is depressed. The duplex length of the exemplary arrangement shown in FIG. 1 extends from the duplex string rest 124 to the capo bar string contact element 132. The speaking length of the string 110 extends from the capo bar string contact element 132 to the first bridge pin 142.

When string 110 is struck by the hammer at the hammer strike point 150, a localized change in tension is created. The L-mode is induced in the string by this initial deflection. Further, this inducement of the L-mode occurs before the ½ wave of the fundamental T-mode has been established and before the hammer has completely left the string 110. This initial deflection creates two L-modes moving down the string 110: one from the hammer strike point 150 toward the bridge 140 in FIG. 1 and shown by arrow 152, and another from the hammer strike point 150 to the capo bar string contact element (e.g., agraffe) 132 and shown by arrow 154.

Some portion of the L-mode illustrated by arrow 154 in FIG. 1 is reflected by the capo bar string contact element 132 but a portion of the L-mode can pass under the capo bar string contact element 132, which operates a pivot termination, to then be reflected by the duplex string rest 124. Duplex string rest 124 can be cast integral with plate 102 or be an added agraffe or a rounded metal element placed between the strings and the plate surface. Dense wood duplex rests (e.g., rosewood, ebony, or other such dense woods) are sometimes used for the duplex rest 124. Such duplex rests help dampen the L-mode, but such duplex rests move with humidity and can react with the string to corrode it.

Figure 2:
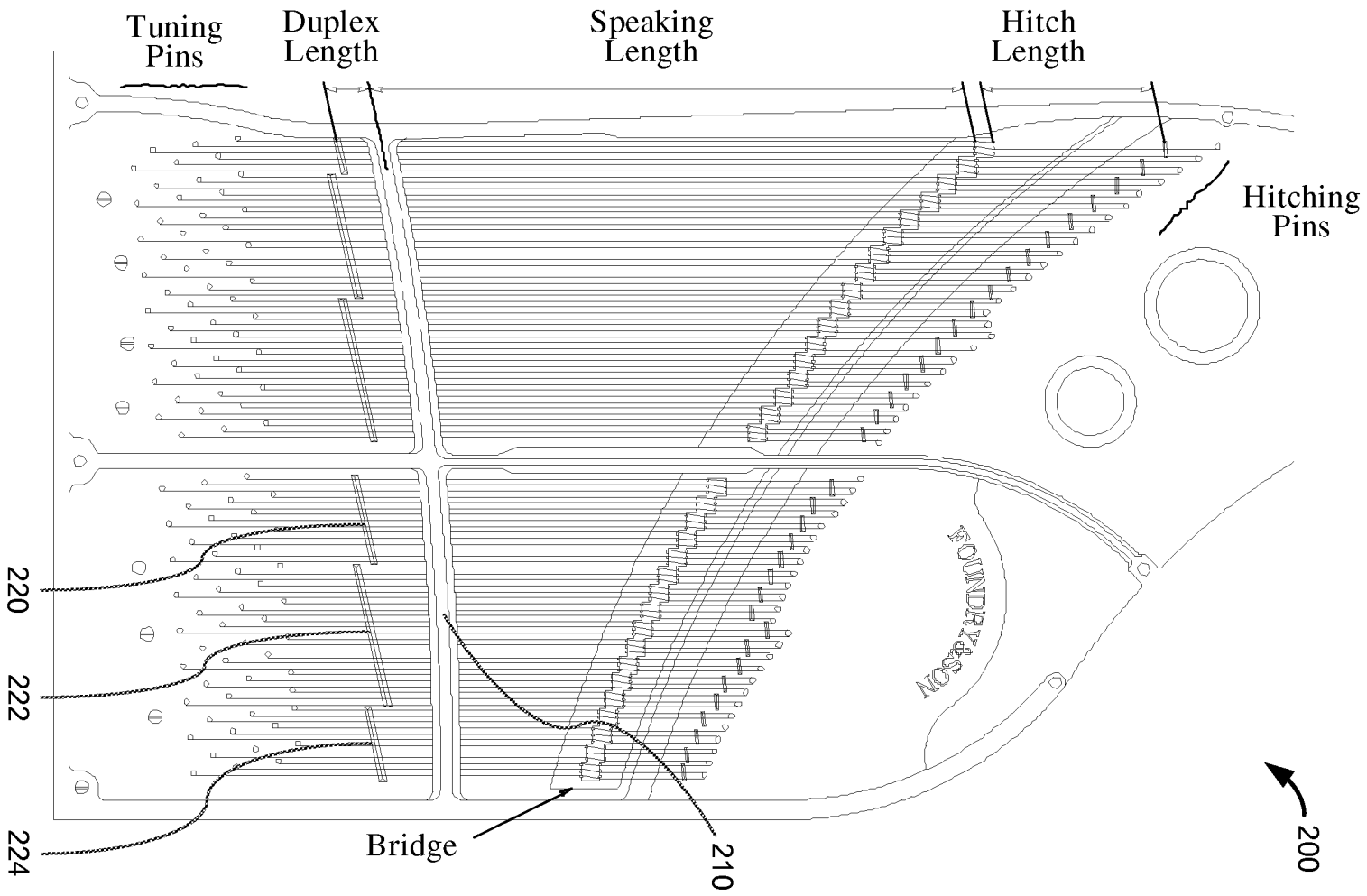
FIG. 2 is a schematic block diagram showing a top view of a portion of a piano having a chromatic duplex arrangement.
Figure 3:
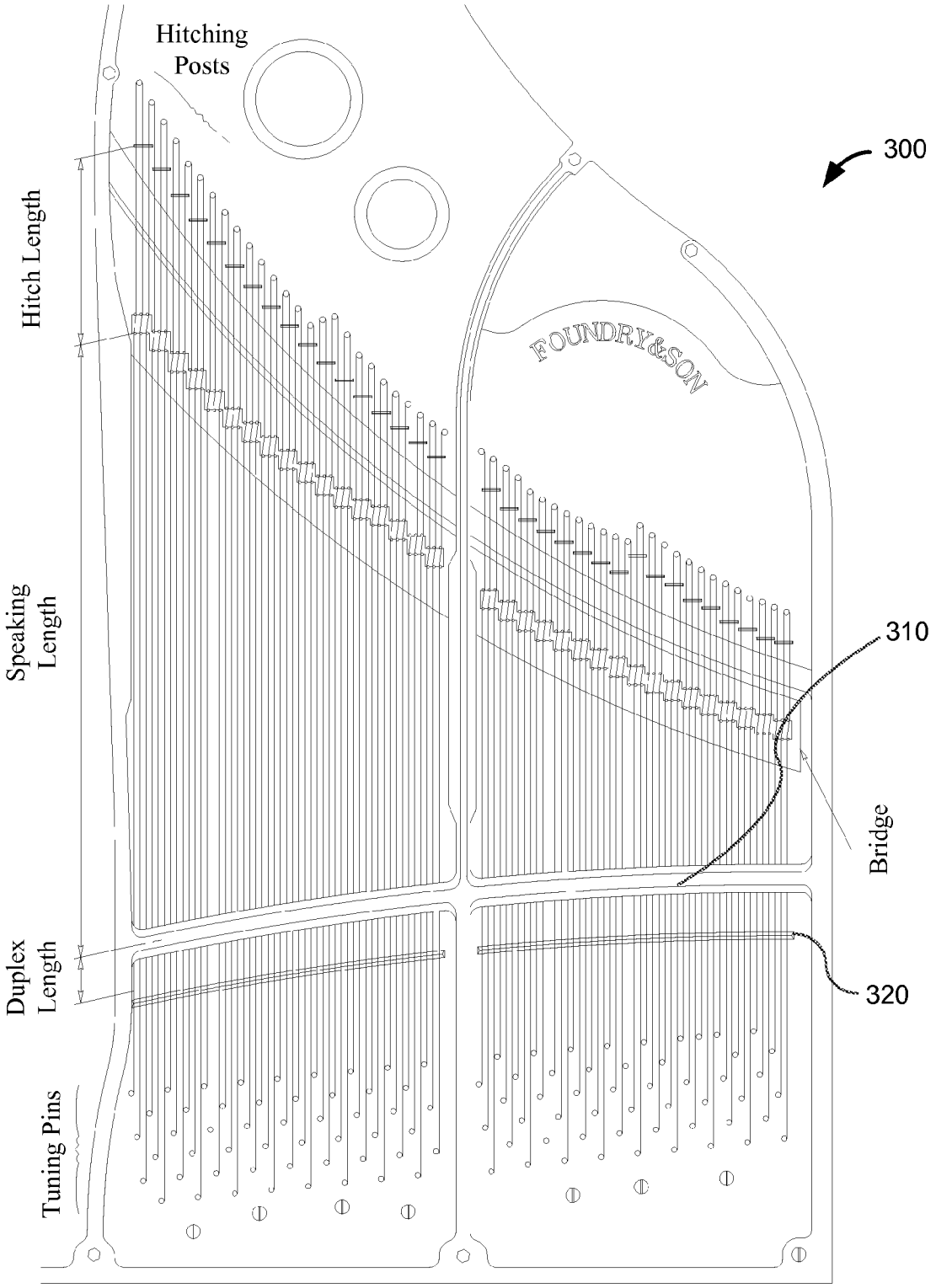
FIG. 3 is a schematic block diagram showing a top view of a portion of a piano having a monotonic duplex arrangement.

FIGS. 2 and 3 are schematic block diagrams showing plan views of two piano layout portions 200, 300 that have duplex segments. In particular, the layout portions 200, 300 only show the highest thirty or so notes of the piano compass.

The layout 200 of FIG. 2 shows a plan view of an exemplary duplex scale. As seen in the layout 200, the duplex length of the strings extends from capo bar 210 to duplex string rests, three of which are shown as duplex string rests 220, 222, 224. In the illustrated embodiment, the duplex segment is un-damped, which allows the stiffer, shorter treble strings to pivot vertically with the hammer impact more easily at the capo bar. This allows the stiff piano strings to pivot at the capo bar in response to the hammer, saving energy and reducing fatigue in the wire. This enables more dynamic range and increased sustain by lessening the effects that wire stiffness has at the forward plate string termination to limit the transfer of energy of the hammer strike into the fundamental T-mode, and to limit the degree of continued freedom of vibration for the struck string segment at the fundamental T-mode.

The capo bar 210 also creates clearance to place the top treble hammers at the ideal strike point without interference at the plate. These features result in a piano with greater dynamic range and longer useful service life to the strings compared to a piano using damped, very short string segments between the tuning pin and string termination.

The duplex lengths can be set to have "harmonic" relationships with their struck string lengths, but such harmonic ratios (e.g., ratios of 2:1, 3:1, 4:1, 5:1, 6:1, 8:1, 10:1, 16:1, and 32:1, etc.) in fact lead to a cacophony of sound that is disruptive to the desired musical context. Duplex lengths set so as not to resonate with the first few partials of the speaking length T-mode fundamental are the preferred configuration.

Another duplex formation is illustrated in FIG. 3 and has a continuous, un-damped duplex string rest across an entire section of notes at the same distance from the capo bar. In particular, FIG. 3 shows a layout 300 having a capo bar 310 and a duplex string rest 320 that extends across an entire section of notes. The extended duplex string rest 320 produces nearly identical duplex lengths, and hence nearly identical duplex pitches, for many consecutive notes. This type of arrangement is referred to as a "monotone duplex".

Some musical problems that have been observed with the duplex scales illustrated in FIGS. 2 and 3 include a harsh "whistle" or "sizzling" sound produced when the notes are played loudly. This is more apparent in notes that have duplex lengths of approximately 40 mm or more. And this is more apparent in some portions of the compass than others. For pianos with monotone duplexes, for instance, some notes will be resonant with many of the duplex segments and these will ring out with an unnatural tonal spectrum. Also, these monotone duplexes will ring over whatever key center the music is attempting to establish, thus confusing the musical content. Further, the tone of pianos with monotone duplexes shorter than 30 mm has a more "nasal" (or E-vowel) quality due to the reduced pivot termination function that reduces the fundamental mode of the struck string. Moreover, when metal duplex rests are used, the metal duplex rests couple the L-mode with the casting, and the casting can ring at these high L-mode frequencies. While it is possible to place felt in the strings between the duplex rest and the capo bar to damp this "sizzle" sound, this hinders the pivot termination and less tone is developed.

Another tonal problem in the treble register of pianos is an excess of hammer impact noise that is coupled by the capo bar to the air, and the motion of some portions of the capo bar in a vector horizontal with the string plane that can propagate, reinforce, or cancel L-mode and T-mode.

Still another problem with the duplex scales of FIGS. 2 and 3 is that undesirably short duplex lengths are used at the top of the compass and the grouping patterns often place too few consecutive notes together in the high treble to take full advantage of the useable duplex ratios that most benefit string pivot. This results in weak high treble tone with some troublesome L-modes and/or T-mode partials. Also, too many consecutive notes are at the same duplex ratio lower in the compass and the ratios are too low. This results in longer duplex segments which makes a tonal break where the capo bar duplex section ends and the agraffe section with damped T-mode pivot termination begins.

It has also been discovered that the energy of the L-modes in the treble portion of a piano compass plays a significant role in determining the musical utility of these notes. It can be demonstrated, for example, that treble string L-mode can become significant because the three unison strings of duplex scales typically differ in length. These length differences consequently produce L-modes of different frequency on each string. These different frequencies produce heterodynes between the L-modes of the unison strings that are low enough in frequency to be heard as a whistle-like sound. This heterodyne effect occurs even when the T-modes of the struck strings are tuned and phased in perfect unison. Further, given the shape of the capo bar, it is typically not possible to make the duplex segments of a multiple string unison note equal in length to result in L-modes of perfect unison when the T-modes of the struck string segment are tuned into perfect unison.

Furthermore, each string of the unisons has L-mode reflection points for the initial L-mode pulse at the capo bar string contact element (e.g., agraffe), at the duplex string rest, and at the bridge. This creates a number of L-mode frequencies carried by an individual string. These L-modes and L-mode heterodynes can also couple into and out of the T-modes at a very rapid rate and sound similar to T-mode heterodynes. These audible heterodynes have been observed between about 1 KHz and 20 KHz.

Further, even when non-harmonic but low duplex ratio lengths are used in the upper half of the keyboard compass, the relatively long duplex lengths will create lower L-mode frequencies. This allows more possible audible range heterodynes between and with T-modes and L-modes of the struck string and its duplex portion. Thus, even if such an arrangement creates a better transfer of the hammer's energy into vertical string motion and greater input to the fundamental T-mode of the struck string, the resulting L-mode heterodyne excitation becomes musically disruptive with the standard metal duplex string rests. Consequently, such a configuration has not been completely successful.

III. Detailed Description

Figure 4:
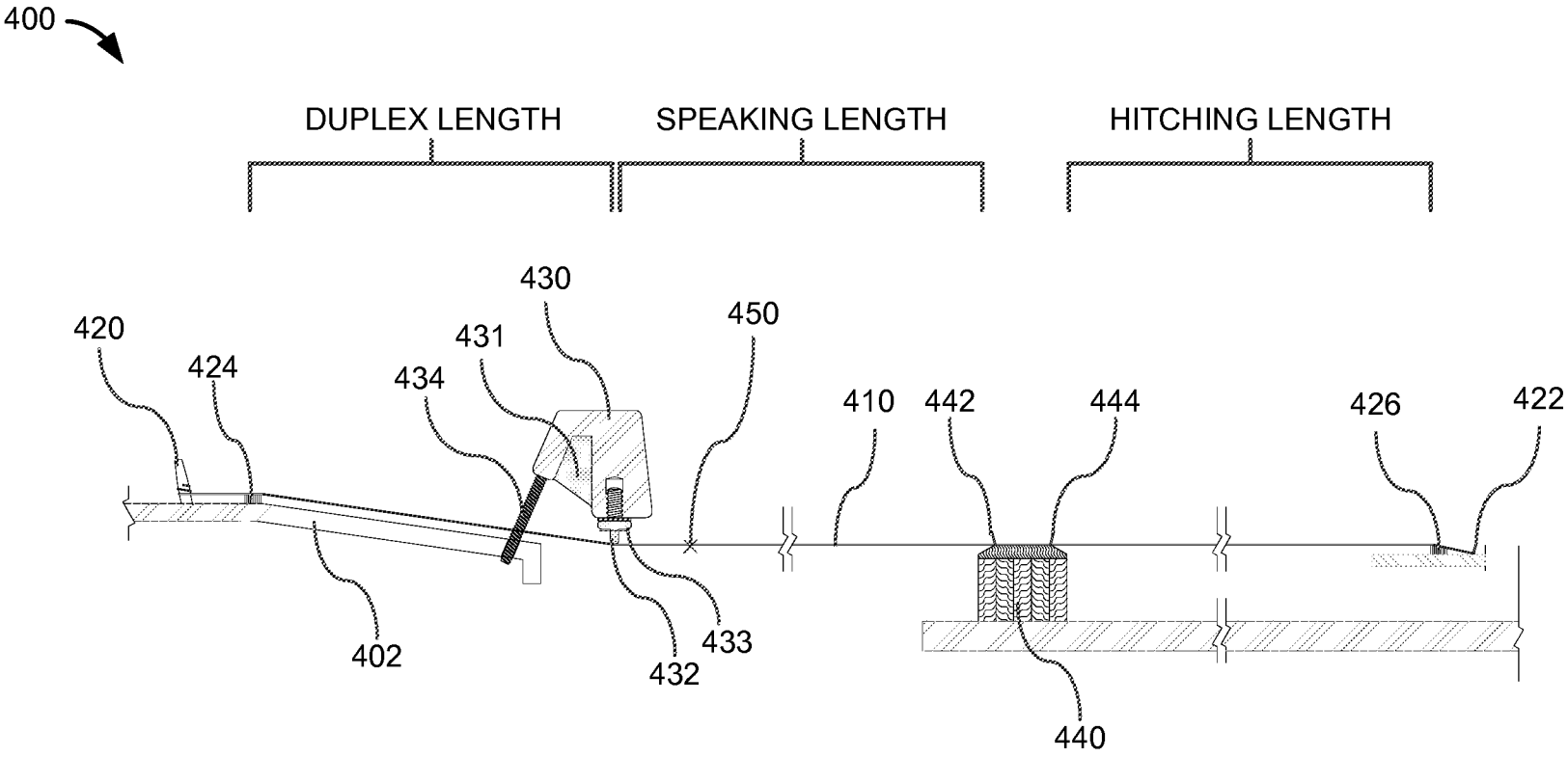
FIG. 4 is a schematic block diagram of an exemplary string arrangement having improved components according to an embodiment of the disclosed technology.

FIG. 4 is a schematic block diagram 400 illustrating an embodiment of components of a piano and a piano string according to the disclosed technology. In particular, FIG. 4 shows a string 410 that extends from a tuning pin 420 to a hitching pin 422. From the tuning pin 420, the string 410 extends over a duplex string rest 424, under capo bar 430 (and in particular, under the capo bar string contact element 432, which serves as a pivot termination), across bridge 440, where it contacts a first bridge pin 442 and a second bridge pin 444, and finally over hitching string rest 426. Also shown in FIG. 4 is a hammer strike point 450 where a hammer of a hammer mechanism (not shown) strikes the string 410 when the corresponding key of the piano is depressed.

The duplex of the exemplary arrangement shown in FIG. 4 extends from the duplex string rest 424 to the capo bar string contact element 432. The speaking length of the string 410 extends from the capo bar string contact element 432 to the first bridge pin 442.

The configuration shown in FIG. 4 illustrates several aspects of the disclosed technology, any of which can be used alone or in any combination or sub-combination with one another. The features of the embodiment illustrated in FIG. 4 are described in further detail in the following subsections.

A. Lengthened Hitching Lengths

It has been discovered that the hitching lengths of the upper half of the keyboard compass have a significant effect on T-mode propagation or reinforcement, L-mode propagation or reinforcement, HT-mode propagation, HT-mode reinforcement, and/or phase canceling motion of the soundboard. This effect can be significant when the angle the strings form with the length of the bridge comes nearest to a right angle, which is the upper 30 or so notes of the keyboard compass.

Hitching lengths do this by influencing the resultant bridge motion into a rocking motion creating horizontal vectors toward and away from the termination point of the struck strings. Pianos typically have hitching lengths with a natural period of fundamental T-mode vibration significantly higher than that of the struck strings across the bridge from them.

The usual industry practice of short hitching lengths creates abundant conditions for some components of the bridge motion to rock toward and away from the vibrating struck string at a higher rate than its fundamental T-mode. This rocking motion can excite, reinforce, and damp L-mode and T-mode in direct relation to their periods. Even when higher period hitching lengths are damped by soft materials, they flex in a way that pulls back on the bridge more quickly than the fundamental T-mode during the first initial wave reflection of the struck string. This can propagate, reinforce and/or cancel L-modes and T-modes at the bridge of the struck string segment depending on respective phase orientation.

T-mode phase cancellation of the struck strings can occur at the bridge when this rocking motion nears a 180-degree-phase difference with the struck string at its termination point. This rocking bridge motion can also contribute to T-mode false beats when it periodically changes the effective speaking length and influences the T-mode to vibrate in a horizontal plane.

Rocking bridge motion can also create phase cancellation in the air when portions of the soundboard on one side of the bridge are out of phase with portions moving on the other side. If the bridge motion is vertical in relation to the string plane, these problems are greatly reduced or eliminated. This can be significant for the strings in the highest half of the 88-note compass because most of the musically significant vibratory information is at the fundamental T-mode of the struck string segment and most soundboards vibrate at more than one location from treble frequencies.

It has been discovered that increasing the hitching lengths in the upper half of the keyboard compass so that their length is equal or nearly equal (e.g., within 200 cents) to their respective struck string's speaking length greatly reduces the first two initial L-modes that arise from the strike point. When the hitching length is equal to or nearly equal to the struck string's speaking length; the timing of the struck string's L-modes reflecting to the bridge from the agraffe or cap bar to the bridge match, or substantially match, the timing of the first L-modes of the hitching length returning to the bridge. Consequently, the ability of the string terminations of the bridge to propagate or reinforce the L-mode is greatly reduced. This also greatly reduces propagation of H-mode from T-mode motion, and greatly reduces the amount of out of phase T-mode soundboard motion. These long hitching lengths desirably have some friction damping from a soft material (such as felt) looped around them, or uncontrolled T-modes will result that cloud the musical utility of the instrument.

In the embodiment illustrated in FIG. 4, the hitching length is extended so that it has a length equal or substantially equal (e.g., within 200 cents) to the speaking length. As noted above, this arrangement significantly reduces the first two initial L-modes that arise from the strike point 450. In certain embodiments, the hitching lengths of one or more of the strings in the upper half of the keyboard compass are equal or nearly equal to the speaking length, and thus can be considered in T-mode unison with the fundamental T-mode of their respective struck string portion. As a result of the increased hitching length(s), rocking bridge motion and the resulting musically disruptive elements can be reduced.

B. Improved Duplex String Rests

In certain embodiments of the disclosed technology, the duplex string rest 424 is configured to provide improved L-mode damping. In particular implementations, for example, the duplex string rest 424 is made from a synthetic material that has one or more of the following characteristics: self-lubricity (e.g., as high as solid polyterafluorethylene), plastic deformation rates (e.g., deformation rates similar to the softest brass), non-hygroscopic properties, resonance peaks at 20 KHz or above, neutral PH, and/or a relatively inert chemical state. For example, the material can comprise a non-metal synthetic manufactured material, such as one or more of: a copolymer or homopolymer, an acetel copolymer (which is sometimes referred to as an "acetal copolymer") (fiber reinforced (e.g., using glass fiber) or not and desirably having a high molecular weight), an acetel homopolymer (fiber reinforced (e.g., using glass fiber) or not and desirably having a high molecular weight), a carbon fiber composite, an aramid fiber composite, a composite of a combination of suitable fibers, a phenolic material (fiber reinforced (e.g., using glass fiber) or not), a nylon material (fiber reinforced (e.g., using glass fiber) or not), polytetrafluorethylene (fiber reinforced (e.g., using glass fiber) or not), any of these materials reinforced with microtubules, microspheres, or nano-scale materials, and/or any other suitable synthetic manufactured material (reinforced or not by any method) that is suitable for the above purpose. These L-Mode damping duplex string rests can be set in patterns that help the complement of useable duplex ratios to be advantageously matched to the compass of any piano and to thereby enhance the freedom of the pivot termination and its' effect upon the string motion and hammer strike. This results in an improved musical utility of any piano.

In certain implementations, the L-mode damping duplex string rests described above are used for only a portion of the full compass of the piano together with any of the duplex arrangements disclosed herein. For instance, the L-mode damping duplex string rests can be used for a portion of the string in the upper range of the compass (e.g., one or more strings above the middle note of the piano compass). In such implementations the remainder of the compass can use a monotone duplex (or no duplex) with or without the L-mode damping duplex string rests.

Further, the L-mode damping duplex scale can be implemented with individual, separate, one-per-unison duplex string rests. Similarly, the L-mode damping duplex rests can be used for two or more unison strings or for two or more strings having a common duplex ratio relative to the speaking length of the strings. For example, the single-note L-mode damping duplex rests can be placed into the same grouping ratio patterns as used for contiguous damping duplex rests.

Still further, some embodiments of the disclosed technology for an L-mode damping duplex scale combine individual duplex string rests per unison with grouped unisons.

C. Improved Hitching Rests

In certain embodiments of the disclosed technology, the hitching rest 426 is made from any of the synthetic materials described above in connection with the L-mode damping duplex rests. For example, the hitching rest can be formed of a synthetic material that has one or more of the following characteristics: self-lubricity, low plastic deformation rates, non-hygroscopic properties, resonance peaks if present at 20 KHz or above, neutral PH, and/or a relatively inert chemical state. For example, the material can comprise a non-metal synthetic material, such as one or more of: a copolymer or homopolymer, acetel copolymer (fiber reinforced (e.g., using glass fiber) or not and desirably having a high molecular weight), an acetel homopolymer (fiber reinforced (e.g., using glass fiber) or not and desirably having a high molecular weight), a carbon fiber composite, an aramid fiber composite, a composite of a combination of suitable fibers, a phenolic material (fiber reinforced (e.g., using glass fiber) or not), a nylon material (fiber reinforced (e.g., using glass fiber) or not), polytetrafluorethylene (fiber reinforced (e.g., using glass fiber) or not), any of these materials reinforced with microtubules, microspheres, or nano-scale materials, and/or any other suitable synthetic manufactured material (reinforced or not by any method) that is suitable for the above purpose. In some embodiments, for instance, the hitching rest has a lubricity substantially the same as polytetrafluorethylene and a hardness substantially the same as soft brass.

When combined with similarly formed duplex rests, embodiments of the disclosed technology comprise an L-mode damping duplex string rest of grouped and/or individual unisons and an L-mode damping hitching length string rest of grouped and/or individual unisons made from a synthetic material (e.g., any of the synthetic materials described above). In such embodiments, the duplex string and the hitching length string rest can be shaped and placed in such a way to damp L-modes and not significantly damp T-modes.

D. Improved Agraffes

Embodiments of the disclosed technology comprise modified agraffes. For example, in certain implementations, one or more agraffes are mounted (e.g., to the capo bar or elsewhere in the piano string assembly) with a spacer (e.g., a washer) made of materials softer than the agraffe, such as lead, soft brass, Babbitt alloy, or dense synthetic manufactured material (e.g., any of the synthetic materials described above). This soft material operates to reduce transmission of the L-mode into the casting, and reduces the reflection of L-mode from that termination point. Any of the non-metal, synthetic material described herein can also be used.

In FIG. 4, for example, the capo bar string contact element 432 is an agraffe that is mounted to the capo bar 430 with a spacer 433 of a relatively soft material. This soft material operates to reduce transmission of the L-mode into the casting, and reduces the reflection of L-mode from that termination point.

E. Improved Capo Bars

Embodiments of the disclosed technology comprise improved capo bars and methods of constructing capo bars. For instance, capo bars according to the disclosed technology have the ability to reflect T-mode, dampen L-mode, and quickly damp the noise of the hammer strike. In particular embodiments, the shape and method of fastening the capo bar to the plate is modified. For instance, in some embodiments, capo bars according to the disclosed technology have cavities into which a suitable damping material can be installed, affixed, or otherwise placed. In further embodiments, the capo bar has a suitable damping material placed between it and the mounting plate. Further, in certain embodiments, the capo bar has suitable damping material used as a spacer between the agraffes and their mounting points (as noted in the previous subsection). And further yet, certain embodiments have a cross sectional shape that improves stiffness. Such embodiments can include cavities that include or add strategically placed damping materials.

FIG. 4, for example, shows a schematic block diagram of an improved capo bar 430 designed according to the disclosed technology. In particular, the capo bar 430 includes a hollow region 431 into which is placed a material that has different and/or greater damping qualities than the plate metal or metal of the capo bar itself. Further, as shown in FIG. 4, the hollow area 431 can be located between a first portion of the capo bar that is coupled to the plate and a second potion of the capo bar that includes or is otherwise coupled to the capo bar string contact element (e.g., agraffe) 432. For example, the material in region 431 can be lead, brass, Babbitt alloy, or a non-metal synthetic manufactured material, such as one or more of: a copolymer or homopolymer, acetel copolymer (fiber reinforced (e.g., using glass fiber) or not and desirably having a high molecular weight), an acetel homopolymer (fiber reinforced (e.g., using glass fiber) or not and desirably having a high molecular weight), an elastomeric silicone compound, an elastomeric polyurethane compound, viscoelastic polyether based polyurethanes or any similarly behaving compounds or combination thereof, an aramid fiber composite, a composite of a combination of suitable fibers, a phenolic material (fiber reinforced (e.g., using glass fiber) or not), a nylon material (fiber reinforced (e.g., using glass fiber) or not), polytetrafluorethylene (fiber reinforced (e.g., using glass fiber) or not), any of these materials reinforced with microtubules, microspheres, or nano-scale materials, and/or any other suitable synthetic manufactured material (reinforced or not by any method) that damps unwanted vibrating noise elements from being coupled to the plate and to the air from the capo bar placed between the plate and its mounting points, and within cavities of the capo bar.

In FIG. 4, the capo bar 430 is attached to plate 402 using a threaded fastener 434. In particular implementations, the threaded fastener 434 is added to reduce vibration between the plate and the capo bar. Further, the large cross-sectional profile of capo bar 430 can improve the stiffness so as to reduce flexing and vibration of the capo in response to the strings vibrations and the striking hammers impulse.

FIGS. 5-8 illustrate other embodiments of a capo bar designed according to the disclosed technology and show various additional reinforcing and damping mechanisms to control movement and vibration of the capo bar and the plate.

Figure 5:
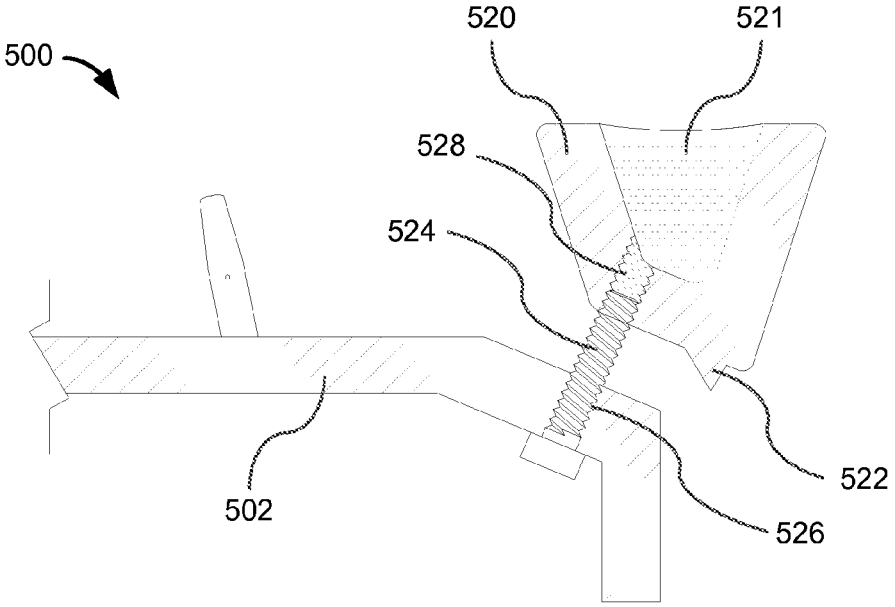
FIGS. 5-7 are schematic block diagrams illustrating exemplary capo bars designed according to embodiments of the disclosed technology.

FIG. 5, for example, is a cross-sectional side view 500 showing a plate 502 and capo bar 520 that includes an integral capo bar string contact element 522 (e.g., an element cast integrally with the capo bar) configured to contact the string (not shown). The capo bar 520 in FIG. 5 has a generally V- or U-shape and includes a region 521 (e.g., a central region or other region formed between two walls of the capo bar) that comprises a material that has different and/or greater damping qualities than the plate metal or capo bar itself. For example, the material in region 521 can be any material as described earlier enclosed in region 431 of FIG. 4.

In FIG. 5, the capo bar 520 is secured to the plate 502 using a threaded fastener 524 (e.g., a threaded lug screw or lug bolt) that extends through a threaded aperture 526 of the plate 502 and a threaded aperture 528 of the capo bar 520.

Figure 6:
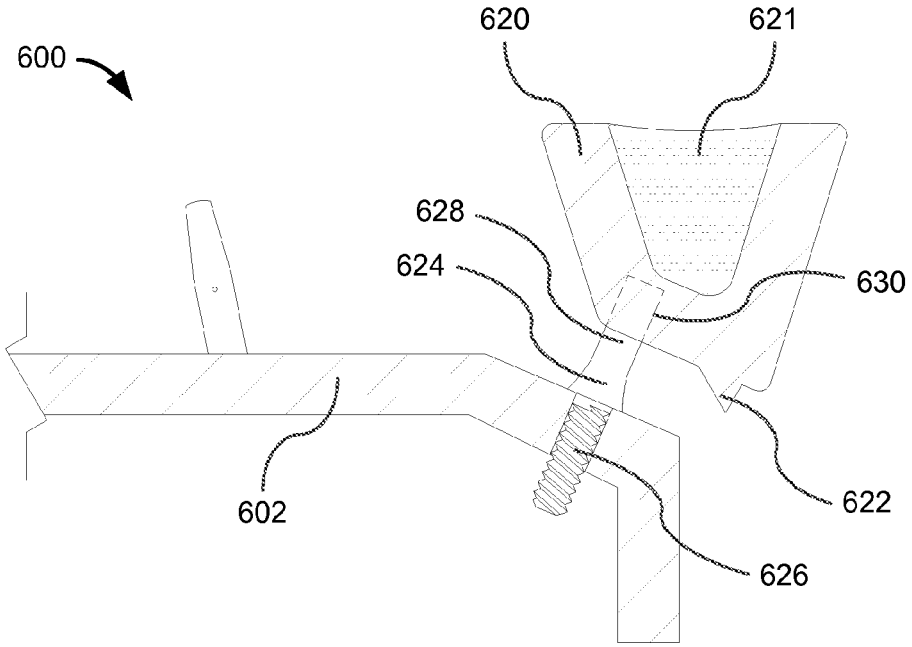

FIG. 6 is a cross-sectional side view 600 showing a plate 602 and bolt-in capo bar 620 that includes an integral capo bar string contact element 622. The capo bar 620 is similar to FIG. 5 but includes a threaded stud 624 that is affixed to the plate 602 by a threaded portion 626 and that engages the capo bar 620 at its stud portion 628. The capo bar 620 of this embodiment includes an aperture 630 sized to receive the stud portion 628. The aperture 630 can be sized with a relatively soft material, such as lead, brass, Babbitt alloy, or other suitable non-metal synthetic manufactured material, such as one or more of: a copolymer or homopolymer, acetel copolymer (fiber reinforced (e.g., using glass fiber) or not and desirably having a high molecular weight), an acetel homopolymer (fiber reinforced (e.g., using glass fiber) or not and desirably having a high molecular weight), a carbon composite, an aramid composite, a composite of a combination of suitable fibers, a phenolic material (fiber reinforced (e.g., using glass fiber) or not), a nylon material (fiber reinforced (e.g., using glass fiber) or not), polytetrafluorethylene (fiber reinforced (e.g., using glass fiber) or not), any of these materials reinforced with microtubuled, microspheres, or nano-scale materials, and/or any other suitable synthetic manufactured material (reinforced or not by any method), so that the fit between the capo bar 620 and the threaded stud 624 is tight and does not allow for vibration. This soft material operates to reduce transmission of any vibration to or from the plate 602 to the capo bar 620. As seen in FIG. 6, the capo bar 620 also comprises a region 621 that can comprise materials such as in 431 in FIG. 4 or 521 in FIG. 5.

Figure 7:
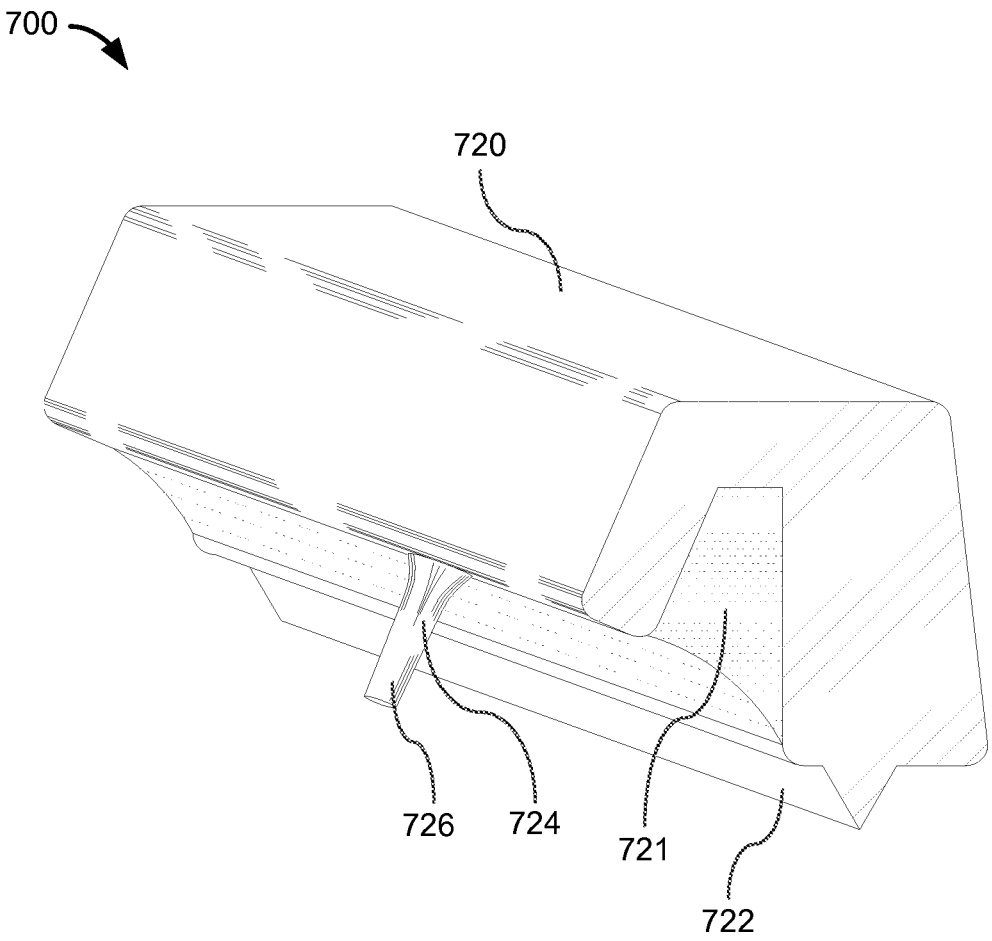

FIG. 7 is a cross-sectional perspective view 700 of another exemplary capo bar 720 that includes an integral capo bar string contact element 722. The capo bar 720 is similar to FIG. 5 but includes a stud 724 having a threaded portion (not shown) that is engaged with a threaded aperture (not shown) of the capo bar 720 and a stud portion 726 that is sized to fit within a corresponding aperture on the plate (not shown). For example, the aperture of the plate can be sized so that the fit between the stud portion 726 of the cast stud 724 and the aperture is tight and does not allow for vibration. The aperture of the plate can be made of a relatively soft material, such as lead, brass, Babbitt alloy, or a non-metal synthetic manufactured material, such as a copolymer or homopolymer, acetel copolymer or (fiber reinforced (e.g., using glass fiber) or not and desirably having a high molecular weight), an acetel homopolymer (fiber reinforced (e.g., using glass fiber) or not and desirably having a high molecular weight), a carbon fiber composite, an aramid fiber composite, a composite of a combination of suitable fibers, a phenolic material (fiber reinforced (e.g., using glass fiber) or not), a nylon material (fiber reinforced (e.g., using glass fiber) or not), polytetrafluorethylene (fiber reinforced (e.g., using glass fiber) or not), any of these materials reinforced with microtubules, microspheres, nano-scale materials, and/or any other suitable synthetic manufactured material (reinforced or not by any method). This soft material operates to reduce transmission of any vibration to or from the plate to the capo bar 720. As seen in FIG. 7, the capo bar 720 also comprises a region 721 that can contain materials as earlier described with respect to element 421 in FIG. 4, 521 in FIGS. 5, and 621 in FIG. 6.

In further embodiments, the cast stud can be cast integrally with the capo bar (e.g., from a single mold). Such capo bars and may or may not include a region formed from a different material (as in region 521).

Further, although the capo bars shown in FIGS. 5-7 include an integral capo bar string contact element for contacting the string, the capo bar string contact element can be implemented as a separate element (such as shown in FIG. 4).

Figure 8:
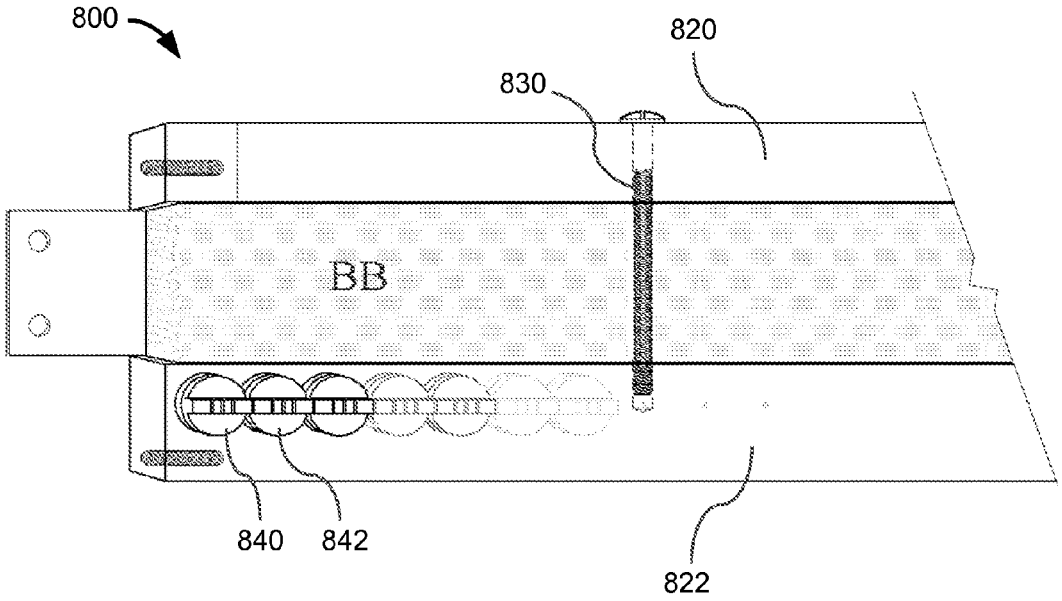
FIGS. 8-9 are schematic block diagrams showing exemplary mechanisms for stabilizing capo bars according to embodiments of the disclosed technology.
Figure 9:
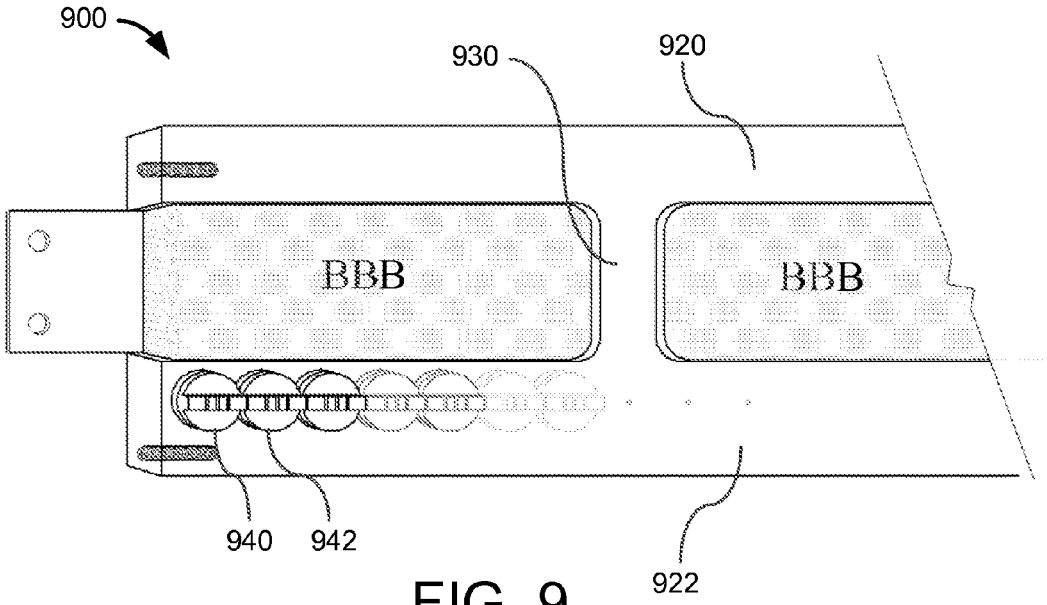

FIGS. 8 and 9 are bottom views 800, 900 of exemplary capo bars 820 and 920 Capo bars 820 and 920 can be any of the capo bars described above but are further constructed to have increased horizontal stiffness. The increased horizontal stiffness can be achieved using either fasteners, such as 830, to engage both sides of the capo bar (as in capo bar 820) or cast braces, such as 930 (as in capo bar 920).

In particular, FIG. 8 shows a first portion 820 (e.g., a first side wall) of the capo bar 820 opposite a second portion 822 (e.g., a second side wall). Exemplary agraffes (e.g., agraffes 840, 842, which can be the improved agraffes described above) are attached to a surface of the second portion 822 and can correspond to the capo bar string contact elements shown in FIGS. 4-7. The area between the first portion 820 and the second portion 822 (labeled as BB) can be filled with suitable damping material as earlier described in 421 FIG. 4, 521 FIG. 5, 621 FIGS. 6, and 721 FIG. 7 that damps unwanted vibrating noise elements. In FIG. 8, the first portion 820 is coupled to the second portion 822 via one or more fasteners (such as threaded fastener 830).

FIG. 9 shows a first portion 920 (e.g., a first side wall) of the capo bar 920 opposite a second portion 922 (e.g., a second side wall). Exemplary agraffes (e.g., agraffes 940, 942, which can be the improved agraffes described above) are attached to a surface of the second portion 822 and can correspond to the capo bar string contact elements shown in FIGS. 4-7. The area between the first portion 920 and the second 922 (labeled as BBB) can be filed with suitable damping material. The material in region BBB can be the same as described earlier with respect to elements 431 in FIG. 4, 521 in FIG. 5, 621 in FIGS. 6 and 721 in FIG. 7 that damp unwanted vibrating noise elements. In FIG. 9, the first portion 920 is integrally coupled to the second portion 922 via one or more braces (such as brace 930) that are integrally cast with the capo bar. In other embodiments, the one or more braces are separate elements that are affixed to the first portion 920 and the second portion 922 (e.g., using appropriate fasteners, such as threaded fasteners or braces made of any of the materials described herein).

F. General String Contact Elements

Any of the L-mode damping materials disclosed herein can be used as a string contact element of a bridge on a piano or like musical instrument that uses a vertical string bearing coupling arrangement rather than the commonly used horizontally staggered two-pin per string arrangement.

G. Duplex Ratios

In general, the formula to determine the duplex ratio for a desired duplex T-mode frequency of a given string is:

$$\text{Duplex ratio} = \frac{\text{Frequency of Duplex}}{\text{Frequency of Speaking Length}}$$

In certain embodiments of the disclosed technology, the duplex lengths are proportioned via ratios that do not result in any musically disruptive consonance between the T-modes of the struck string and its' duplex. For example, the duplex ratios can be selected to be non-harmonic. In particular implementations, for instance, the duplex ratios are selected to exclude ratios equal 1, 2, 3, 4, 5, or 6, or any combination or subcombination thereof (e.g., the duplex ratios used do not include any duplex ratios of 1, 2, 3, 4, 5, or 6). Further, duplex ratios that are substantially equal to 1, 2, 3, 4, 5, or 6 can also be excluded (e.g., duplex ratios that are within 0.15 or less can be excluded as well).

Further, the duplex lengths of some embodiments are grouped into patterns with several consecutive unisons per group. These groupings can be applied to the notes in the higher half of the piano compass. For example, in a particular implementation, the groupings are applied to notes in the upper half of the piano compass, such as the highest 46 to 48 pitched notes of an 88 note piano (where note #40 is middle C @ 261.6 Hz and note #1 is A @ 27.5 Hz).

Table 1 below shows exemplary arrangements of duplex scales showing exemplary grouping patterns and their corresponding duplex ratios. In particular, Table 1 shows grouping patterns of fully tempered duplex ratios for notes #43-88 of the standard piano compass. To determine the duplex length, the speaking lengths for each grouped set of unisons can be divided by a ratio in the identified range (e.g., a single ratio in the identified range or multiple ratios in the identified range). The duplex string rests can then be set to the calculated lengths for their respective unison notes.

For the next stated number of grouped unisons (where each grouped unison corresponds to a separate note in the compass), the duplex lengths can be set to a length determined from a ratio in the corresponding identified range (e.g., a single ratio in the identified range or multiple ratios in the identified range). This process continues across the duplexed compass until the desired effect is achieved. Furthermore, in Table 1, the first grouping corresponds to the grouping with the highest frequency (e.g., the grouping that includes note 88) and proceeds toward lower-frequency groupings.

It should be noted in this discussion of duplex lengths, in Tables 1-3 below, and in the claims, some minor insubstantial deviation in the lengths and duplex ratios is allowed among the strings within a set of unisons and/or between sets of unisons; for example, duplex ratios may vary by plus or minus 3% and still be considered to have the same duplex ratio.

TABLE 1

| | Grouping Patterns for use of Fully Tempered Duplex Ratios $R_1$ through $R_{16}$ Ratio Range | | | | | | | | | | | | | | | |
|---|---|---|---|---|---|---|---|---|---|---|---|---|---|---|---|---|
| Grouping | $1.2 < R_1 < 1.25$ | $1.3 < R_2 < 1.4$ | $1.65 < R_3 < 1.85$ | $2.2 < R_4 < 2.4$ | $2.65 < R_5 < 2.85$ | $3.2 < R_6 < 3.4$ | $3.65 < R_7 < 3.85$ | $4.2 < R_8 \leq 4.8$ | $5.2 < R_9 \leq 5.8$ | $6.2 < R_{10} \leq 7.8$ | $8.2 < R_{11} \leq 9.8$ | $10.2 < R_{12} \leq 11.8$ | $12.2 < R_{13} \leq 13.8$ | $14.2 < R_{14} \leq 15.8$ | $16.2 < R_{15} \leq 17.8$ | $18.2 < R_{16} \leq 19.8$ |
| | Number of consecutive unisons or keys to set at the above duplex ratio | | | | | | | | | | | | | | | |
| 1 | 5 | 5 | 4 | 4 | 4 | 3 | 3 | 3 | 3 | 3 | 3 | 3 | 3 | 0 | 0 | 0 |
| 2 | 0 | 5 | 5 | 5 | 4 | 4 | 4 | 4 | 3 | 3 | 3 | 3 | 3 | 0 | 0 | 0 |
| 3 | 6 | 5 | 4 | 4 | 4 | 4 | 4 | 0 | 3 | 3 | 3 | 3 | 3 | 0 | 0 | 0 |
| 4 | 6 | 0 | 6 | 5 | 5 | 4 | 4 | 4 | 4 | 3 | 3 | 3 | 3 | 0 | 0 | 0 |
| 5 | 6 | 6 | 6 | 6 | 0 | 5 | 0 | 5 | 0 | 0 | 4 | 4 | 4 | 0 | 0 | 0 |
| 6 | 7 | 4 | 6 | 0 | 5 | 4 | 0 | 4 | 0 | 4 | 4 | 4 | 4 | 0 | 0 | 0 |
| 7 | 3 | 4 | 5 | 6 | 4 | 0 | 4 | 0 | 4 | 4 | 4 | 4 | 4 | 0 | 0 | 0 |
| 8 | 3 | 4 | 5 | 6 | 4 | 0 | 4 | 0 | 4 | 4 | 4 | 4 | 4 | 0 | 0 | 0 |
| 9 | 5 | 5 | 0 | 5 | 5 | 0 | 4 | 4 | 4 | 4 | 4 | 3 | 3 | 0 | 0 | 0 |
| 10 | 6 | 0 | 5 | 6 | 6 | 4 | 0 | 4 | 0 | 4 | 4 | 4 | 4 | 0 | 0 | 0 |
| 11 | 5 | 5 | 0 | 4 | 4 | 4 | 0 | 4 | 4 | 4 | 4 | 4 | 4 | 0 | 0 | 0 |
| 12 | 8 | 3 | 4 | 0 | 5 | 4 | 0 | 4 | 4 | 4 | 4 | 3 | 3 | 0 | 0 | 0 |
| 13 | 8 | 7 | 6 | 5 | 4 | 3 | 0 | 3 | 0 | 3 | 3 | 3 | 2 | 0 | 0 | 0 |
| 14 | 8 | 0 | 7 | 6 | 5 | 4 | 0 | 4 | 3 | 3 | 2 | 2 | 2 | 0 | 0 | 0 |
| 15 | 7 | 6 | 5 | 4 | 0 | 4 | 4 | 4 | 0 | 3 | 3 | 3 | 3 | 0 | 0 | 0 |
| 16 | 0 | 8 | 7 | 6 | 5 | 4 | 3 | 3 | 0 | 3 | 3 | 3 | 1 | 0 | 0 | 0 |
| 17 | 8 | 7 | 6 | 5 | 4 | 3 | 3 | 2 | 0 | 2 | 2 | 2 | 2 | 0 | 0 | 0 |
| 18 | 6 | 5 | 5 | 5 | 5 | 0 | 4 | 4 | 0 | 3 | 3 | 3 | 3 | 0 | 0 | 0 |
| 19 | 2 | 4 | 6 | 5 | 5 | 4 | 0 | 4 | 4 | 3 | 3 | 3 | 3 | 0 | 0 | 0 |

TABLE 1-continued

| Grouping | Grouping Patterns for use of Fully Tempered Duplex Ratios $R_1$ through $R_{16}$ Ratio Range | | | | | | | | | | | | | | | |
|---|---|---|---|---|---|---|---|---|---|---|---|---|---|---|---|---|
| | $1.2 < R_1 < 1.25$ | $1.3 < R_2 < 1.4$ | $1.65 < R_3 < 1.85$ | $2.2 < R_4 < 2.4$ | $2.65 < R_5 < 2.85$ | $3.2 < R_6 < 3.4$ | $3.65 < R_7 < 3.85$ | $4.2 < R_8 \leq 4.8$ | $5.2 < R_9 \leq 5.8$ | $6.2 < R_{10} \leq 7.8$ | $8.2 < R_{11} \leq 9.8$ | $10.2 < R_{12} \leq 11.8$ | $12.2 < R_{13} \leq 13.8$ | $14.2 < R_{14} \leq 15.8$ | $16.2 < R_{15} \leq 17.8$ | $18.2 < R_{16} \leq 19.8$ |
| | Number of consecutive unisons or keys to set at the above duplex ratio | | | | | | | | | | | | | | | |
| 20 | 2 | 6 | 7 | 4 | 0 | 4 | 4 | 4 | 3 | 3 | 3 | 3 | 2 | 0 | 0 | 0 |
| 21 | 3 | 8 | 6 | 5 | 4 | 4 | 0 | 4 | 4 | 3 | 3 | 3 | 2 | 0 | 0 | 0 |
| 22 | 5 | 6 | 7 | 5 | 0 | 4 | 0 | 4 | 3 | 3 | 3 | 3 | 3 | 0 | 0 | 0 |
| 23 | 5 | 5 | 4 | 0 | 4 | 4 | 0 | 4 | 0 | 4 | 0 | 4 | 3 | 3 | 3 | 3 |
| 24 | 5 | 0 | 6 | 4 | 0 | 4 | 4 | 0 | 4 | 0 | 4 | 0 | 4 | 4 | 3 | 3 |
| 25 | 0 | 7 | 4 | 5 | 4 | 0 | 4 | 3 | 3 | 3 | 0 | 3 | 0 | 3 | 3 | 3 |
| 26 | 2 | 7 | 5 | 0 | 5 | 0 | 5 | 4 | 0 | 4 | 4 | 0 | 3 | 3 | 2 | 2 |
| 27 | 8 | 5 | 4 | 0 | 4 | 4 | 0 | 3 | 0 | 3 | 3 | 0 | 3 | 3 | 3 | 3 |
| 28 | 3 | 3 | 3 | 3 | 3 | 3 | 3 | 3 | 3 | 3 | 3 | 3 | 3 | 3 | 2 | 2 |
| 29 | 6 | 5 | 4 | 3 | 3 | 0 | 3 | 0 | 3 | 3 | 3 | 3 | 3 | 3 | 2 | 2 |
| 30 | 5 | 5 | 4 | 4 | 0 | 4 | 0 | 3 | 0 | 3 | 3 | 3 | 3 | 3 | 3 | 3 |
| 31 | 6 | 0 | 6 | 5 | 0 | 5 | 4 | 4 | 0 | 4 | 0 | 3 | 3 | 2 | 2 | 2 |
| 32 | 3 | 7 | 0 | 5 | 0 | 5 | 4 | 0 | 4 | 4 | 4 | 0 | 3 | 3 | 2 | 2 |
| 33 | 8 | 0 | 7 | 5 | 4 | 0 | 4 | 4 | 4 | 0 | 4 | 0 | 3 | 0 | 2 | 1 |
| 34 | 6 | 5 | 4 | 0 | 4 | 4 | 4 | 0 | 6 | 6 | 6 | 6 | 6 | 2 | 2 | 0 |
| 35 | 5 | 6 | 7 | 0 | 5 | 4 | 0 | 4 | 0 | 3 | 3 | 0 | 3 | 0 | 3 | 3 |
| 36 | 0 | 8 | 7 | 6 | 5 | 4 | 0 | 3 | 0 | 3 | 3 | 0 | 3 | 0 | 3 | 1 |
| 37 | 2 | 6 | 5 | 0 | 4 | 0 | 4 | 4 | 0 | 4 | 0 | 4 | 4 | 3 | 3 | 3 |
| 38 | 7 | 6 | 5 | 0 | 4 | 4 | 0 | 4 | 0 | 4 | 0 | 3 | 0 | 3 | 3 | 3 |
| 39 | 6 | 5 | 0 | 6 | 6 | 0 | 6 | 4 | 0 | 4 | 4 | 0 | 3 | 0 | 3 | 2 |
| 40 | 7 | 0 | 6 | 5 | 0 | 4 | 4 | 4 | 0 | 4 | 0 | 3 | 0 | 3 | 3 | 3 |
| 41 | 0 | 5 | 5 | 4 | 4 | 4 | 0 | 3 | 0 | 3 | 3 | 3 | 3 | 3 | 3 | 3 |

To illustrate the application of Table 1, consider grouping 40. Starting with the highest note (note 88) of a standard 88-key piano, the groupings and determination of the duplex lengths could proceed as illustrated in Table 2 (where the ratios indicated are exemplary ratios within the ranges identified in Table 1 and where some of the intermediate keys are omitted for the sake of brevity).

TABLE 2

| Duplex Length Example | | | |
|---|---|---|---|
| Key | Duplex Ratio | Speaking Unison Length (mm) | Duplex Unison Length (mm) |
| 88 | 1.23 | 53.0 | 43.1 |
| 82 | 1.23 | 73.1 | 59.4 |
| 81 | 1.7 | 77.1 | 45.4 |
| 76 | 1.7 | 100.8 | 59.3 |
| 75 | 2.3 | 106.3 | 46.2 |
| 71 | 2.3 | 131.7 | 57.3 |
| 70 | 3.3 | 138.9 | 42.1 |
| 67 | 3.3 | 163.1 | 49.4 |
| 66 | 3.7 | 172.1 | 46.5 |
| 63 | 3.7 | 202.1 | 54.6 |
| 62 | 4.5 | 213.2 | 47.4 |
| 59 | 4.5 | 250.4 | 55.6 |
| 58 | 7 | 264.1 | 37.7 |
| 55 | 7 | 310.2 | 44.3 |
| 54 | 11 | 327.2 | 29.7 |
| 52 | 11 | 364.2 | 33.1 |
| 51 | 15 | 384.3 | 25.6 |
| 49 | 15 | 427.7 | 28.5 |
| 48 | 17 | 451.2 | 26.5 |
| 46 | 17 | 502.2 | 29.5 |
| 45 | 19 | 529.8 | 27.9 |
| 43 | 19 | 589.7 | 31.0 |

In general, certain ones of the duplex scales illustrated in Tables 1 and 2 exhibit certain characteristics, any one or more of which can be present in embodiments of the disclosed technology. For example, in embodiments of the disclosed technology, the number of grouped notes associated with a given duplex ratio (or duplex string rest) decreases as the notes are considered from highest to lowest (or, equivalently, the number of grouped notes associated with a given duplex ratio (or duplex string rest) increases as the notes are considered from lowest to highest). In other words, the duplex ratios associated with lower notes in any duplex scale are associated with fewer numbers of notes than with higher notes in the duplex scale. Still further, in particular embodiments, the largest grouping of notes with the same duplex ratio is the grouping with the highest frequency among the groupings in a duplex scale.

Still further, in the exemplary duplex ratios shown in Tables 1 and 2, the duplex ratios are non-harmonic. In particular, the duplex ratios are selected to exclude harmonic ratios of 1, 2, 3, 4, 5, and 6. Further, duplex ratios that are within 0.15 of the harmonic ratios are also excluded. It is also to be understood that higher ratios than those listed are possible in the lower portion of the duplex compass. For instance, ratios such as 21, 22, 23, 25, 26, 27, 28, 29, 30, and 31 can be fit to the lower duplex compass to further reduce the pivot termination to blend with the damped pivot string termination conditions of the mid and lower portions of a piano's compass. These ratios and their placement in the compass are considered to be within the scope of the disclosed technology.

Further yet, Tables 1, 2, and 3 illustrate that the duplex lengths of the strings in the upper half of the compass are longer than in conventional piano compasses. For instance, the duplex ratios can be 0.15 less than a 1.0 ratio (e.g., a 1.15 ratio or higher), indicating a much longer duplex string length than used in any conventional piano compass.

Table 3 shows yet another embodiment of the disclosed technology in which the duplex ratios are unique for each note. In particular, Table 3 describes the duplex ratios for each of notes 43-88 in a standard 88 key piano compass. Pianos incorporating any one or more of these duplex ratios are considered to be within the scope of the disclosed technology.

TABLE 3

| Graduated Duplex Ratios | | |
|---|---|---|
| Note | Ratio | Grp. |
| 88 | 1.20 | 1 |
| 87 | 1.25 | |
| 86 | 1.30 | |
| 85 | 1.35 | |
| 84 | 1.40 | |
| 83 | 1.45 | |
| 82 | 1.50 | |
| 81 | 1.55 | |
| 80 | 1.60 | |
| 79 | 1.65 | |
| 78 | 1.70 | |
| 77 | 1.75 | |
| 76 | 1.80 | |
| 75 | 2.20 | 2 |
| 74 | 2.30 | |
| 73 | 2.45 | |
| 72 | 2.55 | 2 |
| 71 | 2.65 | |
| 70 | 2.80 | |
| 69 | 3.20 | 3 |
| 68 | 3.35 | |
| 67 | 3.50 | |
| 66 | 3.70 | |
| 65 | 3.80 | |
| 64 | 4.20 | 4 |
| 63 | 4.60 | |
| 62 | 4.80 | |
| 61 | 5.20 | 5 |
| 60 | 5.60 | |
| 59 | 6.20 | 6 |
| 58 | 6.50 | |
| 57 | 6.80 | |
| 56 | 7.30 | 7 |
| 55 | 7.80 | |
| 54 | 8.30 | 8 |
| 53 | 9.30 | 9 |
| 52 | 10.30 | 10 |
| 51 | 11.30 | 11 |
| 50 | 12.40 | 12 |
| 49 | 13.50 | 13 |
| 48 | 14.70 | 14 |
| 47 | 15.80 | 15 |
| 46 | 16.80 | 16 |
| 45 | 17.80 | 17 |
| 44 | 19.80 | 18 |
| 43 | 21.80 | 19 |

In general, the duplex ratios illustrated in Table 3 exhibit certain unique characteristics, any one or more of which can be present in an embodiment of the disclosed technology. For example, each note can have its own duplex ratio. Further, in such embodiments, the unison strings of each note can have the same ratio as each other or they can vary slightly. Thus, the particular duplex ratios in Table 3 should be considered as examples only, and any piano or stringed instrument in which one or more consecutive notes have separate, independent duplex ratios are considered to be within the scope of the disclosed technology. Furthermore, the duplex ratios can be graduated so that they increase as one moves from a higher note to a lower note (e.g., from note 88 to note 43). (Equivalently, the ratios can be viewed as decreasing as one moves form a lower note to a higher note (e.g., from note 43 to note 88)).

As noted above, in this discussion and in the claims, some minor insubstantial deviation in the lengths and duplex ratios is allowed among the strings within a set of unisons; for example, duplex ratios may vary by plus or minus 3% or less and still be considered to have the same duplex ratio.

Figure 10:
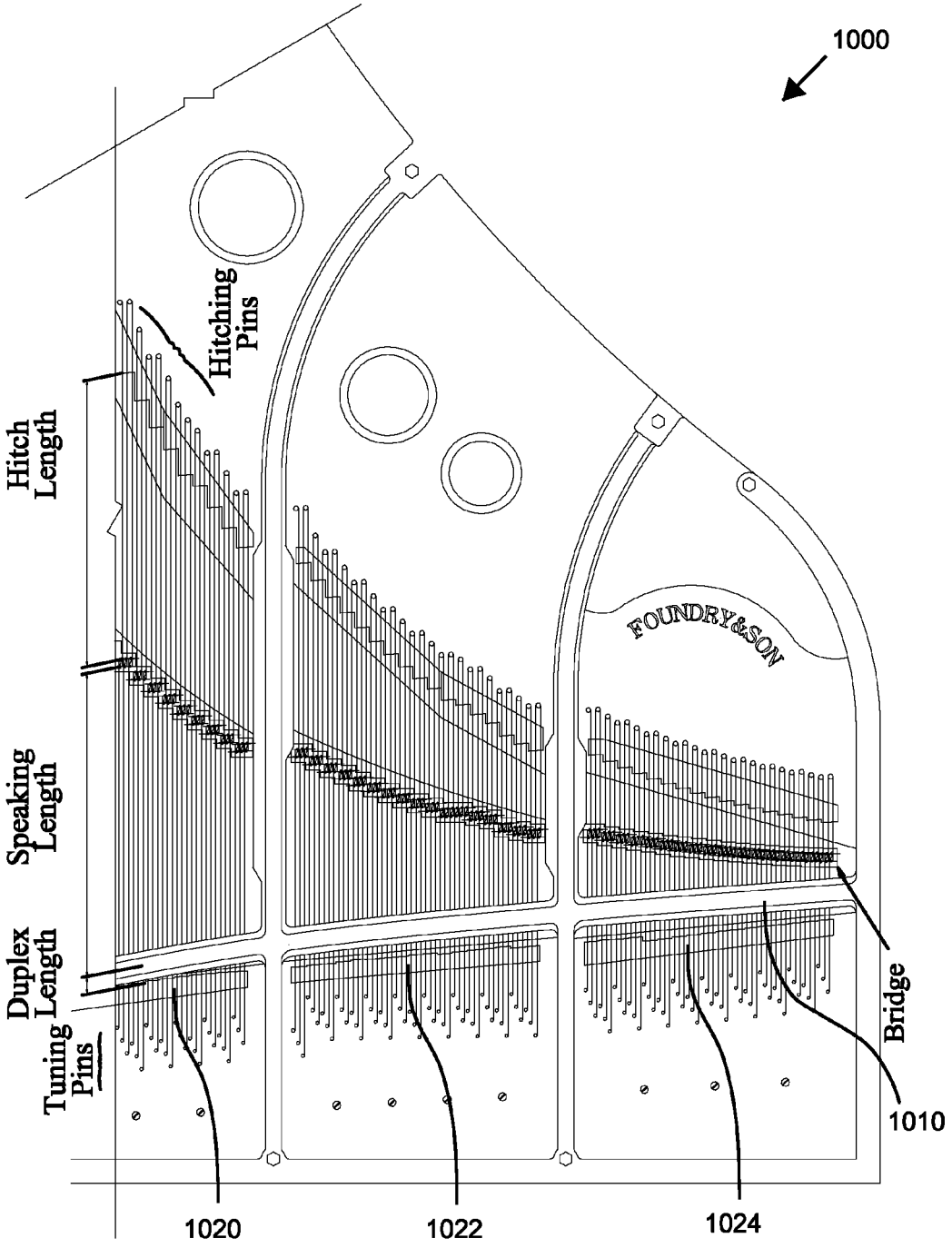
FIG. 10 is a schematic block diagram showing a top view of a portion of a piano having a graduated duplex ratio grouping arrangement according to an embodiment of the disclosed technology.

As illustrated by Table 3, duplex scales according to the disclosed technology can be implemented with graduated duplex ratios distributed across the compass so the resultant duplex lengths vary by relatively small amounts between adjacent notes compared to duplex groupings with the same general ratio. By graduating the duplex ratios, the number of duplex rests can be reduced compared to single duplex ratio groupings. For example, a duplex rest that achieves the illustrated graduated ratios has a shape that more easily fits between the capo bar and the tuning pins of a conventional piano and can also serve as the duplex rest for multiple unison string sets. FIG. 10, for instance, shows an arrangement having just three duplex rests. In particular, FIG. 10 shows a layout 1000 having a capo bar 1010 and three exemplary duplex string rests 1020, 1022, 1024 configured according to embodiments of the disclosed technology. As can be seen, the duplex string rests 1020, 1022, 1024 comprise one-piece duplex string rests that are appropriately shaped and placed such that the unison strings of each note have the desired respective ratio. In general, the duplex string rests 1020, 1022, 1024 create consecutively graduated ratios where the ratios for adjacent unison string sets are different from one another and gradually increase as the frequency of the notes descend. The shape of the duplex string rest can vary from implementation to implementation, but in the illustrated embodiment, the duplex string rests 1020, 1022, 1024 have a graduated, stepped shape resulting from the different ratios being provided by the duplex string rests. Further, the number of duplex string rests may vary from implementation to implementation. For example, any number of duplex string rests may be used (e.g., between 5 to 9). Additionally, some duplex string rests may span multiple string sets while others may only support a single string set.

As shown by the column labeled "Grp." in Table 3, the duplex ratios specified in Table 3 can be grouped into groupings of notes associated with a given duplex ratio range, where the duplex ratios within the given duplex ratio range exclude certain harmonic ratios (e.g., the duplex ratios in the range exclude ratios of 1, 2, 3, 4, 5, 6 and/or potentially higher harmonic ratios). Further, in Table 3, for notes 60-88 the number of grouped notes associated with a given duplex ratio range decreases as the notes are considered from highest to lowest (or, equivalently, the number of grouped notes associated with a given duplex ratio range increases as the notes are considered from lowest to highest). In other words, for notes 60-88, the duplex ratio ranges associated with the lower notes are associated with fewer numbers of notes than with higher notes in the duplex scale. Still further, in particular embodiments, the largest grouping of notes in the same duplex ratio range is the grouping with the highest frequency among the groupings in a duplex scale.

Still further, in the exemplary duplex ratios shown in Table 3, the duplex ratios are non-harmonic. In particular, the duplex ratios are selected to exclude harmonic ratios of 1, 2, 3, 4, 5, 6, 8, 10, 12, etc. Further, duplex ratios that are within 0.15 of the harmonic ratios are also excluded. It is also to be understood that higher ratios than those listed in Table 3 are also possible in the lower portion of the duplex compass. For instance, ratios such as 21, 22, 23, 25, 26, 27, 28, 29, 30, and 31 and their fractional possibilities can be fit to the lower duplex compass to further reduce string pivot termination to blend with the middle and lowest portions of a pianos compass. These ratios and their placement are considered to be within the scope of the disclosed technology.

Further yet, Table 3 illustrates that the duplex lengths of the strings in the upper half of the compass are longer than in conventional piano compasses. For example, the duplex ratio of one or more strings can be less than 1.5, indicating a much longer duplex string length than used in any conventional piano compass.

In certain embodiments, the duplex string rests are manufactured of a suitable synthetic material, such as an acetel copolymer (e.g., reinforced or not with fiber, such as glass fiber), an acetel homopolymer (e.g., reinforced or not with fiber, such as glass fiber), or any other of the synthetic materials identified above. Such duplex rests can be more easily shaped into one piece per section of strings, these duplex rests being shaped to provide termination points for the duplexes at the calculated lengths in proportion to the struck string lengths.

As noted, the duplex scale according to any of the disclosed embodiments can extend beyond the 88 notes of a standard piano compass. Further, duplex ratios below 1, such as 0.85 can be used above note 88 (and, in some instance, for notes below note 88) in order to produce a fundamental T-mode duplex frequency below that of the struck string. Such embodiments can be combined, for example, with the L-mode damping string rest as described above. For example, in one particular implementation, notes 89-93 have the following duplex ratios: note 93=0.080; note 92=0.082; note 91=0.085; note 90=0.087; and note 89=0.089.

Further, any of the disclosed duplex scales disclosed herein can be used in combination with one another. For instance, duplex scales determined according to the principles illustrated by Table 1, Table 2, or Table 3 can be used in combination with a monotone duplex for certain notes (e.g., together with the improved duplex string rests disclosed herein).

Additionally, for any of the embodiments disclosed herein, the number of duplex string rests will vary from implementation to implementation. For example, any number of duplex string rests may be used (e.g., between 5 to 9). Additionally, some duplex string rests may span multiple string sets while others may only support a single string set.

In general, pianos or other stringed instruments exhibiting any one or more of the disclosed characteristics (regardless of whether the duplex ratios of such instruments can be found within one of the exemplary groupings in Table 1, 2, or 3) are considered to be within the scope of the disclosed technology. It is also to be understood that the disclosed technology is not limited to the particular arrangements described above. For example, pianos with a treble extended above the present 88-note compass can implement embodiments of the disclosed technology. Further, as the duplex ratios diverge from those stated in Tables 1, 2 and 3, the sound quality will change accordingly. The disclosed technology further encompasses duplex ratios substantially similar to those disclosed in Tables 1, 2, and 3 (e.g., plus or minus 20 cents of the calculated pitch).

As noted, any of the disclosed features can be used alone or in combination with one another. For example, in certain embodiments, any of the disclosed duplex ratios and grouping patterns are placed in the compass with L-mode damping duplex string rests that are made from a synthetic material having a relatively high self-lubricity, acceptably low plastic deformation rates, non-hygroscopic properties, resonance peaks (if present) at 20 KHz or above, neutral pH, and/or is in a relatively inert chemical state. As noted above, that material can be a very-large molecular weight acetel copolymer (fiber reinforced (e.g., using glass fiber) or not and desirably having a high molecular weight), an acetel homopolymer (fiber reinforced (e.g., using glass fiber) or not and desirably having a high molecular weight); a carbon fiber composite; an aramid fiber composite; a composite of a combination of suitable fibers; a phenolic material (fiber reinforced (e.g., using glass fiber) or not); a nylon material (fiber reinforced (e.g., using glass fiber) or not); polytetrafluorethylene (fiber reinforced (e.g., using glass fiber) or not); any of these materials reinforced with microtubules or microspheres or nano-scale materials; and/or any other suitable synthetic manufactured material, reinforced or not by any method, that is suitable for the above purpose.

These L-Mode damping duplex string rests can be set in patterns that help ensure the full complement of useable ratios is most advantageously matched to the compass of any piano to benefit the freedom of the pivot termination and its' effect upon the string motion and hammer strike. This results in an improved musical utility of any piano. In certain implementations, the L-mode damping string rests can be fitted with grooves and/or holes to space the strings laterally, thus easing the installation of strings during assembly.

Also, any of the L-mode damping materials disclosed herein can be used as a string contact point on a bridge that uses a vertical string bearing arrangement rather than the more common two-pin-stagger per string side bearing arrangement.

The disclosed technologies can be used with any type of piano or like musical instrument to which they could be applied. Further, while the following factors in combination are desirable, any piano comprising one or more of: low, single digit, non-harmonic duplex ratios; including any of those shown in Table 1, Table 2, or Table 3; higher non-harmonic duplex ratios (e.g., 7:1, 9:1, 11:1, 13:1, 15:1, 17:1, 19:1, 21:1, 22:1, 23:1; 25:1, 26:1, 27:1, 28:1, and/or 29:1) including any of those shown in Table 1, Table 2, or Table 3); an L-mode damping string rest as described above; an L-mode damping agraffe washer as described above; an L-mode damping capo bar as described above; an L-mode damping string rest component of a vertical bearing string termination bridge feature as described above; an L-mode damping string rest with grooves or holes to space the strings horizontally as described above; a capo with increased horizontal stiffness as described above; a capo bar constructed to minimize transmission of the hammer strike noise as described above; or a struck string length equal or substantially equal to hitching lengths for any portion of the top half of the keyboard are considered to be within the scope of the disclosed technology.

Having illustrated and described the principles of the disclosed technology, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only preferred examples of the technologies and should not be taken as limiting the scope of the invention. Rather, the scope of the invention is defined by the following claims. I therefore claim as my invention all that comes within the scope and spirit of these claims.

What is claimed is:

1. A stringed instrument, comprising:

a plurality of string sets, each string set comprising one or more strings having a speaking length portion tuned to a respective frequency, the string sets together forming a graduated musical scale that ascends from a lower frequency to a higher frequency, the strings of each respective string set being divided between at least a duplex length portion and the speaking length portion, a ratio between a length of string in the speaking length portion and a length of string in the duplex length portion defining a duplex ratio, the string sets being further arranged into at least a first grouping of two or more of the string sets and a second grouping of two or more of the string sets, wherein the duplex ratios of the string sets in the first grouping are consecutively graduated from one another and are all within a first duplex ratio range having no harmonic duplex ratios, wherein the duplex ratios of the strings in the second grouping are consecutively graduated from one another and are all within a second duplex ratio range having no harmonic duplex ratios, the second duplex ratio range being separated from the first duplex ratio range by at least one harmonic duplex ratio, wherein the strings in the first grouping are tuned to higher frequencies than the strings in the second grouping, and wherein the strings of each respective string set further include a hitching length portion, the hitching length portion for a respective string being equal or substantially equal in length to the speaking length portion for the respective string.

2. The stringed instrument of claim 1, wherein the stringed instrument is a piano having notes, and wherein the duplex ratios for two or more string sets of the stringed instrument are defined by a grouping shown in the following table:

| Note | Ratio | Grp. |
|---|---|---|
| 88 | 1.20 | 1 |
| 87 | 1.25 | |
| 86 | 1.30 | |
| 85 | 1.35 | |
| 84 | 1.40 | |
| 83 | 1.45 | |
| 82 | 1.50 | |
| 81 | 1.55 | |
| 80 | 1.60 | |
| 79 | 1.65 | |
| 78 | 1.70 | |
| 77 | 1.75 | |
| 76 | 1.80 | |
| 75 | 2.20 | 2 |
| 74 | 2.30 | |
| 73 | 2.45 | |
| 72 | 2.55 | |
| 71 | 2.65 | |
| 70 | 2.80 | |
| 69 | 3.20 | 3 |
| 68 | 3.35 | |
| 67 | 3.50 | |
| 66 | 3.70 | |
| 65 | 3.80 | |
| 64 | 4.20 | 4 |
| 63 | 4.60 | |
| 62 | 4.80 | |
| 61 | 5.20 | 5 |
| 60 | 5.60 | |
| 59 | 6.20 | 6 |
| 58 | 6.50 | |
| 57 | 6.80 | |
| 56 | 7.30 | 7 |
| 55 | 7.80 | |
| 54 | 8.30 | 8 |
| 53 | 9.30 | 9 |
| 52 | 10.30 | 10 |
| 51 | 11.30 | 11 |
| 50 | 12.40 | 12 |
| 49 | 13.50 | 13 |
| 48 | 14.70 | 14 |
| 47 | 15.80 | 15 |
| 46 | 16.80 | 16 |
| 45 | 17.80 | 17 |
| 44 | 19.80 | 18 |
| 43 | 21.80 | 19. |

3. The stringed instrument of claim 1, wherein each string set has a duplex ratio different than the duplex ratio of any other string set.

4. The stringed instrument of claim 1, wherein the number of string sets in the first grouping is greater than the number of string sets in the second grouping.

5. The stringed instrument of claim 1, further comprising duplex string rests positioned at a termination of the duplex length portion of the strings, the duplex string rests comprising an acetel copolymer, an acetel homopolymer, a carbon fiber composite, an aramid fiber composite, a phenolic material, a nylon material, or a polytetrafluorethylene.

6. The stringed instrument of claim 5, wherein at least one of the duplex string rests has graduated string lengths resulting in a stepped shape.

7. The stringed instrument of claim 1, further comprising duplex string rests positioned at a termination of the duplex length portion of the strings, the duplex string rests comprising a non-metal synthetic material configured to reduce transmission of the longitudinal vibrational mode on at least one of the strings.

8. The stringed instrument of claim 1, further comprising a capo bar having a capo bar string contact element that contacts the strings at a division of the duplex portion and the speaking length portion of the strings, wherein the capo bar comprises a hollow portion in which a damping material is positioned, the damping material comprising one of lead, brass, Babbitt alloy, an acetel copolymer, an acetel homopolymer, an elastomeric silicone compound, an elastomeric polyurethane compound, polyurethane, an aramid fiber composite, a phenolic material, a nylon material, or polytetrafluorethylene.

9. The stringed instrument of claim 1, further comprising hitching rests positioned at terminations of the hitching length portions of the strings, the hitching string rests comprising a non-metal synthetic material configured to reduce transmission of the longitudinal vibrational mode on at least one of the strings.

10. The stringed instrument of claim 1, wherein the stringed instrument is a piano.

11. The stringed instrument of claim 10, wherein the plurality of string sets are in an upper half of the piano's compass.

12. A stringed instrument, comprising:

a plurality of string sets, each string set comprising one or more strings having a speaking length portion tuned to a respective frequency, the string sets together forming a graduated musical scale that ascends from a lower frequency to a higher frequency, the strings of each respective string set being divided between at least a duplex length portion and the speaking length portion, a ratio between a length of string in the speaking length portion and a length of string in the duplex length portion defining a duplex ratio, the string sets being further arranged into at least a first grouping of two or more of the string sets and a second grouping of two or more of the string sets, the strings in the first grouping having a first duplex ratio and the strings in the second grouping having a second duplex ratio, wherein the strings in the first grouping are tuned to higher frequencies than the strings in the second grouping, wherein the number of string sets in the first grouping is greater than the number of string sets in the second grouping, and wherein the strings of each respective string set further include a hitching length portion, the hitching length portion for a respective string set being equal or substantially equal in length to the speaking length portion for the respective string set.

13. The stringed instrument of claim 12, further comprising a third grouping of two or more of the string sets having a third duplex ratio, wherein the strings in the first grouping and the second grouping are tuned to higher frequencies than the strings in the third grouping, and wherein the number of string sets in the first grouping and the second grouping is greater than the number of string sets in the third grouping.

14. The stringed instrument of claim 12, wherein the number of string sets in each grouping increases as the frequency of the strings in each grouping increases.

15. The stringed instrument of claim 12, wherein the duplex ratios for two or more string sets of the stringed instrument are defined by a grouping shown in the following table:

16. The stringed instrument of claim 12, wherein the duplex ratios for the plurality of string sets exclude harmonic ratios or substantially harmonic ratios.

17. The stringed instrument of claim 12, further comprising a capo bar having a capo bar string contact element that contacts the strings at a division of the duplex portion and the speaking length portion of the strings.

18. The stringed instrument of claim 12, wherein the capo bar comprises a hollow portion in which a damping material is positioned, the damping material comprising lead, brass, Babbitt alloy, an acetel copolymer, an acetel homopolymer, an elastomeric silicone compound, an elastomeric polyurethane compound, polyurethane, an aramid fiber composite, a phenolic material, a nylon material, or polytetrafluorethylene.

19. The stringed instrument of claim 12, further comprising hitching rests positioned at terminations of the hitching length portions of the strings, the hitching string rests comprising a non-metal synthetic material configured to reduce transmission of the longitudinal vibrational mode on at least one of the strings.

Grouping Patterns for Duplex Ratios $R_1$ through $R_{16}$

| Ratio Range | 1.2 < $R_1$ < 1.25 | 1.3 < $R_2$ < 1.4 | 1.65 < $R_3$ < 1.85 | 2.2 < $R_4$ < 2.4 | 2.65 < $R_5$ < 2.85 | 3.2 < $R_6$ < 3.4 | 3.65 < $R_7$ < 3.85 | 4.2 < $R_8$ ≤ 4.8 | 5.2 < $R_9$ ≤ 5.8 | 6.2 < $R_{10}$ ≤ 7.8 | 8.2 < $R_{11}$ ≤ 9.8 | 10.2 < $R_{12}$ ≤ 11.8 | 12.2 < $R_{13}$ ≤ 13.8 | 14.2 < $R_{14}$ ≤ 15.8 | 16.2 < $R_{15}$ ≤ 17.8 | 18.2 < $R_{16}$ ≤ 19.8 |
|---|---|---|---|---|---|---|---|---|---|---|---|---|---|---|---|---|
| Grouping | Number of consecutive unisons or keys to set at the above duplex ratio | | | | | | | | | | | | | | | |
| 1 | 5 | 5 | 4 | 4 | 4 | 3 | 3 | 3 | 3 | 3 | 3 | 3 | 3 | 0 | 0 | 0 |
| 2 | 0 | 5 | 5 | 5 | 4 | 4 | 4 | 4 | 3 | 3 | 3 | 3 | 3 | 0 | 0 | 0 |
| 3 | 6 | 5 | 4 | 4 | 4 | 4 | 4 | 0 | 3 | 3 | 3 | 3 | 3 | 0 | 0 | 0 |
| 4 | 6 | 0 | 6 | 5 | 5 | 4 | 4 | 4 | 4 | 3 | 3 | 3 | 3 | 0 | 0 | 0 |
| 5 | 6 | 6 | 6 | 6 | 0 | 5 | 0 | 5 | 0 | 0 | 4 | 4 | 4 | 0 | 0 | 0 |
| 6 | 7 | 4 | 6 | 0 | 5 | 4 | 0 | 4 | 0 | 4 | 4 | 4 | 4 | 0 | 0 | 0 |
| 7 | 3 | 4 | 5 | 6 | 4 | 0 | 4 | 0 | 4 | 4 | 4 | 4 | 4 | 0 | 0 | 0 |
| 8 | 3 | 4 | 5 | 6 | 4 | 0 | 4 | 0 | 4 | 4 | 4 | 4 | 4 | 0 | 0 | 0 |
| 9 | 5 | 5 | 0 | 5 | 5 | 0 | 4 | 4 | 4 | 4 | 4 | 3 | 3 | 0 | 0 | 0 |
| 10 | 6 | 0 | 5 | 6 | 6 | 4 | 0 | 4 | 0 | 4 | 4 | 4 | 4 | 0 | 0 | 0 |
| 11 | 5 | 5 | 0 | 4 | 4 | 4 | 0 | 4 | 4 | 4 | 4 | 4 | 4 | 0 | 0 | 0 |
| 12 | 8 | 3 | 4 | 0 | 5 | 4 | 0 | 4 | 4 | 4 | 4 | 3 | 3 | 0 | 0 | 0 |
| 13 | 8 | 7 | 6 | 5 | 4 | 3 | 0 | 3 | 0 | 3 | 3 | 3 | 2 | 0 | 0 | 0 |
| 14 | 8 | 0 | 7 | 6 | 5 | 4 | 0 | 4 | 3 | 3 | 2 | 2 | 2 | 0 | 0 | 0 |
| 15 | 7 | 6 | 5 | 4 | 0 | 4 | 4 | 4 | 0 | 3 | 3 | 3 | 3 | 0 | 0 | 0 |
| 16 | 0 | 8 | 7 | 6 | 5 | 4 | 3 | 3 | 0 | 3 | 3 | 3 | 1 | 0 | 0 | 0 |
| 17 | 8 | 7 | 6 | 5 | 4 | 3 | 3 | 2 | 0 | 2 | 2 | 2 | 2 | 0 | 0 | 0 |
| 18 | 6 | 5 | 5 | 5 | 5 | 0 | 4 | 4 | 0 | 3 | 3 | 3 | 3 | 0 | 0 | 0 |
| 19 | 2 | 4 | 6 | 5 | 5 | 4 | 0 | 4 | 4 | 3 | 3 | 3 | 3 | 0 | 0 | 0 |
| 20 | 2 | 6 | 7 | 4 | 0 | 4 | 4 | 4 | 3 | 3 | 3 | 3 | 2 | 0 | 0 | 0 |
| 21 | 3 | 8 | 6 | 5 | 4 | 4 | 0 | 4 | 4 | 3 | 3 | 3 | 2 | 0 | 0 | 0 |
| 22 | 5 | 6 | 7 | 5 | 0 | 4 | 0 | 4 | 3 | 3 | 3 | 3 | 3 | 0 | 0 | 0 |
| 23 | 5 | 5 | 4 | 0 | 4 | 4 | 0 | 4 | 0 | 4 | 0 | 4 | 3 | 3 | 3 | 3 |
| 24 | 5 | 0 | 6 | 4 | 0 | 4 | 4 | 0 | 4 | 0 | 4 | 0 | 4 | 4 | 3 | 3 |
| 25 | 0 | 7 | 4 | 5 | 4 | 0 | 4 | 3 | 3 | 3 | 0 | 3 | 0 | 3 | 3 | 3 |
| 26 | 2 | 7 | 5 | 0 | 5 | 0 | 5 | 4 | 0 | 4 | 4 | 0 | 3 | 3 | 2 | 2 |
| 27 | 8 | 5 | 4 | 0 | 4 | 4 | 0 | 3 | 0 | 3 | 3 | 0 | 3 | 3 | 3 | 3 |
| 28 | 3 | 3 | 3 | 3 | 3 | 3 | 3 | 3 | 3 | 3 | 3 | 3 | 3 | 3 | 2 | 2 |
| 29 | 6 | 5 | 4 | 3 | 3 | 0 | 3 | 0 | 3 | 3 | 3 | 3 | 3 | 3 | 2 | 2 |
| 30 | 5 | 5 | 4 | 4 | 0 | 4 | 0 | 3 | 0 | 3 | 3 | 3 | 3 | 3 | 3 | 3 |
| 31 | 6 | 0 | 6 | 5 | 0 | 5 | 4 | 4 | 0 | 4 | 0 | 3 | 3 | 2 | 2 | 2 |
| 32 | 3 | 7 | 0 | 5 | 0 | 5 | 4 | 0 | 4 | 4 | 4 | 0 | 3 | 3 | 2 | 2 |
| 33 | 8 | 0 | 7 | 5 | 4 | 0 | 4 | 4 | 4 | 0 | 4 | 0 | 3 | 0 | 2 | 1 |
| 34 | 6 | 5 | 4 | 0 | 4 | 4 | 4 | 0 | 6 | 6 | 6 | 6 | 6 | 2 | 2 | 0 |
| 35 | 5 | 6 | 7 | 0 | 5 | 4 | 0 | 4 | 0 | 3 | 3 | 0 | 3 | 0 | 3 | 3 |
| 36 | 0 | 8 | 7 | 6 | 5 | 4 | 0 | 3 | 0 | 3 | 3 | 0 | 3 | 0 | 3 | 1 |
| 37 | 2 | 6 | 5 | 0 | 4 | 0 | 4 | 4 | 0 | 4 | 0 | 4 | 4 | 3 | 3 | 3 |
| 38 | 7 | 6 | 5 | 0 | 4 | 4 | 0 | 4 | 0 | 4 | 0 | 3 | 0 | 3 | 3 | 3 |
| 39 | 6 | 5 | 0 | 6 | 6 | 0 | 6 | 4 | 0 | 4 | 4 | 0 | 3 | 0 | 3 | 2 |
| 40 | 7 | 0 | 6 | 5 | 0 | 4 | 4 | 4 | 0 | 4 | 0 | 3 | 0 | 3 | 3 | 3 |
| 41 | 0 | 5 | 5 | 4 | 4 | 4 | 0 | 3 | 0 | 3 | 3 | 3 | 3 | 3 | 3 | 3. |

20. The stringed instrument of claim 12, further comprising duplex string rests positioned at a termination of the duplex length portion of the strings, the duplex string rests comprising one or more of an acetel copolymer, an acetel homopolymer, a carbon fiber composite, an aramid fiber composite, a phenolic material, a nylon material, or polytetrafluorethylene.

21. The stringed instrument of claim 12, wherein the stringed instrument is a piano.

22. The stringed instrument of claim 12, wherein the plurality of string sets are in an upper half of the piano's compass.

23. A stringed instrument, comprising:

a plurality of string sets, each string set comprising strings tuned to a respective frequency, the string sets being arranged so that the respective frequencies for the string sets progress from a lower frequency to a higher frequency, the strings of each respective string sets being divided between at least a duplex length portion and a speaking length portion, a ratio between a length of the strings in the speaking length portion and a length of the strings in the duplex length portion defining a duplex ratio; and a duplex string rest positioned at a termination of the duplex length portion of at least one of the strings, the duplex string rest comprising a non-metal synthetic material configured to reduce transmission of the longitudinal vibrational mode on the at least one of the strings, and wherein the strings of each respective string set further include a hitching length portion, the hitching length portion for a respective string set being equal or substantially equal in length to the speaking length portion for the respective string set.

24. The stringed instrument of claim 23, wherein the synthetic material comprises an acetel copolymer.

25. The stringed instrument of claim 23, wherein the duplex string rest is a first duplex string rest for a first string set, the stringed instrument comprising a second duplex string rest for a second string set, the second duplex string rest defining a different duplex length than the duplex length of the first duplex string rest and being separate from the first duplex string rest.

26. The stringed instrument of claim 23, wherein the synthetic material is one of an acetel copolymer, an acetel homopolymer, a carbon fiber composite, an aramid fiber composite, a phenolic material, a nylon material, or polytetrafluorethylene.

27. The stringed instrument of claim 23, further comprising a capo bar having a capo bar element that contacts the at least one of the strings at a division of the duplex portion and the speaking length portion of the at least one of the strings, the capo bar element also comprising the non-metal synthetic material.

28. The stringed instrument of claim 27, wherein the capo bar element is an agraffe consisting essentially of the non-metal synthetic material.

29. The stringed instrument of claim 23, wherein the duplex string rest has a graduated, stepped shape and is configured to serve as the duplex string rest for multiple ones of the string sets.

30. The stringed instrument of claim 29, wherein the stepped shape of the duplex string rest is designed to create a common duplex ratio for each string in a respective string set and to create different duplex ratios between each of the multiple ones of the grouped string sets.

31. The stringed instrument of claim 23, wherein the stringed instrument is a piano.

32. The stringed instrument of claim 31, wherein the plurality of string sets are in the upper half of the piano's compass.

33. A stringed instrument, comprising:

a plurality of strings;

a capo bar coupled to a frame of the stringed instrument and having a capo bar string contact element that contacts the plurality of strings and thereby divides the strings into duplex length portions and speaking length portions, the capo bar being formed of a first material and defining a hollow region; and a damping element formed from a second material different than the first material and located in the hollow region of the capo bar, the second material being configured to dampen the transmission of vibrations from the capo bar string contact element to the frame of the stringed instrument, wherein each of the strings includes a speaking length portion and a hitching length portion, the hitching length portion for a respective string being equal or substantially equal in length to the speaking length portion for the respective string.

34. The stringed instrument of claim 33, wherein the damping element is formed of a non-metal synthetic material.

35. The stringed instrument of claim 33, wherein the damping element is formed of lead, brass, or Babbitt alloy.

36. The stringed instrument of claim 33, wherein the capo bar is coupled to the frame via a non-metal synthetic element.

37. The stringed instrument of claim 33, wherein the capo bar string contact element is coupled to the capo bar by a non-metal synthetic element.

38. The stringed instrument of claim 33, wherein the stringed instrument is a piano.

39. A stringed instrument, comprising:

a plurality of string sets, each string set comprising strings tuned to a respective frequency, the string sets being arranged so that respective frequencies for the string sets progress from a lower frequency to a higher frequency; and a string rest positioned at a termination of a speaking length of at least one of the strings, the string rest comprising a non-metal synthetic material configured to reduce transmission of the longitudinal vibrational mode on the at least one of the strings, wherein the strings of each respective string set further include a speaking length portion and a hitching length portion, the hitching length portion for a respective string set being equal or substantially equal in length to the speaking length portion for the respective string set.

40. The stringed instrument of claim 39, wherein the synthetic material is an acetel copolymer.

41. The stringed instrument of claim 39, wherein the synthetic material is one of an acetel copolymer, an acetel homopolymer, a carbon fiber composite, an aramid fiber composite, a phenolic material, a nylon material, or polytetrafluorethylene.

42. The stringed instrument of claim 39, further comprising a bridge on which the string rest is positioned.

43. A stringed instrument, comprising:

a plurality of string sets, each string set comprising strings tuned to a respective frequency, the string sets being arranged so that the respective frequencies for the string sets progress from a lower frequency to a higher frequency, the strings of each respective string sets being divided between at least a hitching length portion and a speaking length portion; and a hitching string rest positioned at a termination of the hitching length portion of at least one of the strings, the hitching string rest comprising a non-metal synthetic material configured to reduce transmission of the longitudinal vibrational mode on the at least one of the strings, wherein the strings of each respective string set further include a speaking length portion and a hitching length portion, the hitching length portion for a respective string set being equal or substantially equal in length to the speaking length portion for the respective string set.

44. The stringed instrument of claim 43, wherein the hitching string rest is a first hitching string rest for a first string set, the stringed instrument comprising a second hitching string rest for a second string set, the second hitching string rest defining a different hitching length than the hitching length of the first hitching string rest and being separate from the first hitching string rest.

* * * * *